US011079166B2

(12) United States Patent
Choe et al.

(10) Patent No.: US 11,079,166 B2
(45) Date of Patent: Aug. 3, 2021

(54) REFRIGERATOR

(71) Applicant: LG ELECTRONICS INC., Seoul (KR)

(72) Inventors: Jongchan Choe, Seoul (KR); Hyoungjun Park, Seoul (KR); Sanghun Cho, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 16/798,057

(22) Filed: Feb. 21, 2020

(65) Prior Publication Data

US 2020/0271373 A1 Aug. 27, 2020

(30) Foreign Application Priority Data

Feb. 22, 2019 (KR) ..... 10-2019-0021237

(51) Int. Cl.

| | |
|---|---|
| ***F25D 23/02*** | (2006.01) |
| ***F25D 23/06*** | (2006.01) |
| ***F25D 27/00*** | (2006.01) |
| ***F25D 29/00*** | (2006.01) |
| ***G09G 3/20*** | (2006.01) |

(52) U.S. Cl.

CPC ..... *F25D 23/028* (2013.01); *F25D 23/061* (2013.01); *F25D 23/065* (2013.01); *F25D 27/00* (2013.01); *F25D 29/005* (2013.01); *G09G 3/2096* (2013.01); *F25D 2327/001* (2013.01); *F25D 2400/36* (2013.01); *F25D 2400/40* (2013.01)

(58) Field of Classification Search

CPC ..... F25D 29/005; F25D 2400/361; F25D 23/028; F25D 27/005; F25D 2323/021; F25D 2323/023; F25D 2400/36; F25D 2400/40; F25D 2700/04; F25D 23/025; F25D 29/00; A47F 3/0434; G09F 9/35; G09G 3/2096

See application file for complete search history.

(56) References Cited

U.S. PATENT DOCUMENTS

| | | | | |
|---|---|---|---|---|
| 2007/0236910 | A1 | 10/2007 | Yun et al. | |
| 2008/0143871 | A1 | 6/2008 | Go | |
| 2012/0285089 | A1* | 11/2012 | Artwohl | A47F 3/0434 49/70 |

(Continued)

FOREIGN PATENT DOCUMENTS

| | | |
|---|---|---|
| CN | 1717618 | 1/2006 |
| CN | 101082719 | 12/2007 |

(Continued)

OTHER PUBLICATIONS

European Search Report dated Jul. 9, 2020 issued in EP Application No. 20158739.1.

(Continued)

*Primary Examiner* — Koosha Sharifi-Tafreshi
(74) *Attorney, Agent, or Firm* — Ked & Associates, LLP

(57) ABSTRACT

The present disclosure relates to a refrigerator. In the refrigerator according to an embodiment, an outer spacer supporting a display is grounded with a ground, and electromagnetic waves transmitted from the outer spacer is charged to the outside. Therefore, the electromagnetic waves can be prevented as acting on a display image as a noise.

19 Claims, 26 Drawing Sheets

(56) References Cited

U.S. PATENT DOCUMENTS

| | | | | |
|---|---|---|---|---|
| 2017/0176095 | A1 | 6/2017 | Kobos et al. | |
| 2017/0191746 | A1 | 7/2017 | Seo | |
| 2018/0025679 | A1* | 1/2018 | Park | A47F 3/0434 345/156 |
| 2018/0061283 | A1 | 3/2018 | Kim et al. | |
| 2018/0274852 | A1 | 9/2018 | Kang et al. | |
| 2018/0310726 | A1 | 11/2018 | Oh et al. | |

FOREIGN PATENT DOCUMENTS

| | | |
|---|---|---|
| CN | 101202839 | 6/2008 |
| EP | 3 287 047 | 2/2018 |
| EP | 3 378 359 | 9/2018 |
| JP | 2003-240429 | 8/2003 |
| KR | 10-2011-0089535 | 8/2011 |
| RU | 2 511 232 | 4/2014 |
| WO | WO 2018/199478 | 11/2018 |

OTHER PUBLICATIONS

Indian Office Action dated Feb. 3, 2021 issued in IN Application No. 202014001694.

Chinese Office Action dated Jun. 1, 2021 issued in CN Application No. 202010059640.5.

* cited by examiner

REFRIGERATOR

CROSS-REFERENCE TO RELATED APPLICATION(S)

This application claims priority under 35 U.S.C. 119 and 35 U.S.C. 365 to Korean Patent Application No. 10-2019-0021237, filed in Korea on Feb. 22, 2019 in Korea, the entire contents of which is hereby incorporated by reference in its entirety.

BACKGROUND

1. Field

The present disclosure relates to a refrigerator.

2. Background

In general, a refrigerator refers to a home appliance that stores foods at a low temperature in an inner storage space covered by a door. To achieve this, the refrigerator is configured to store foods in an optimum state by cooling the inside of the storage space by using cool air generated through heat exchange with a refrigerant circulating through a refrigeration cycle.

According to recent changes in dietary life and the trend toward high-quality products, refrigerators have become bigger and have advanced to have multiple functions, and refrigerators having various structures and convenience devices for the sake of user convenience and efficient utilization of inner spaces are being introduced.

A storage space of a refrigerator may be opened and closed by a door. In addition, refrigerators may be classified into various types of refrigerators according to arrangement of the storage space and a structure of the door for opening and closing the storage space.

Typically, there is a problem that foods inside the refrigerator cannot be checked unless the door is opened. That is, a user should open the door in order to check whether desired food is stored in the space of the refrigerator or to check whether the food is stored in a separate storage space on the door. In addition, when the user does not know exactly where food is, the door may be opened for a long time or the number of times of opening the door may increase. In this case, there is a problem of unnecessary discharge of cool air.

To solve these problems, a refrigerator having a transparent part of a door, or having a transparent unit to allow the inside of the refrigerator to be visible is developing. In addition, the door may be provided with a display and may be configured to output a screen.

BRIEF DESCRIPTION OF THE DRAWINGS

Embodiments will be described in detail with reference to the following drawings in which like reference numerals refer to like elements, and wherein.

DETAILED DESCRIPTION

Figure 1:
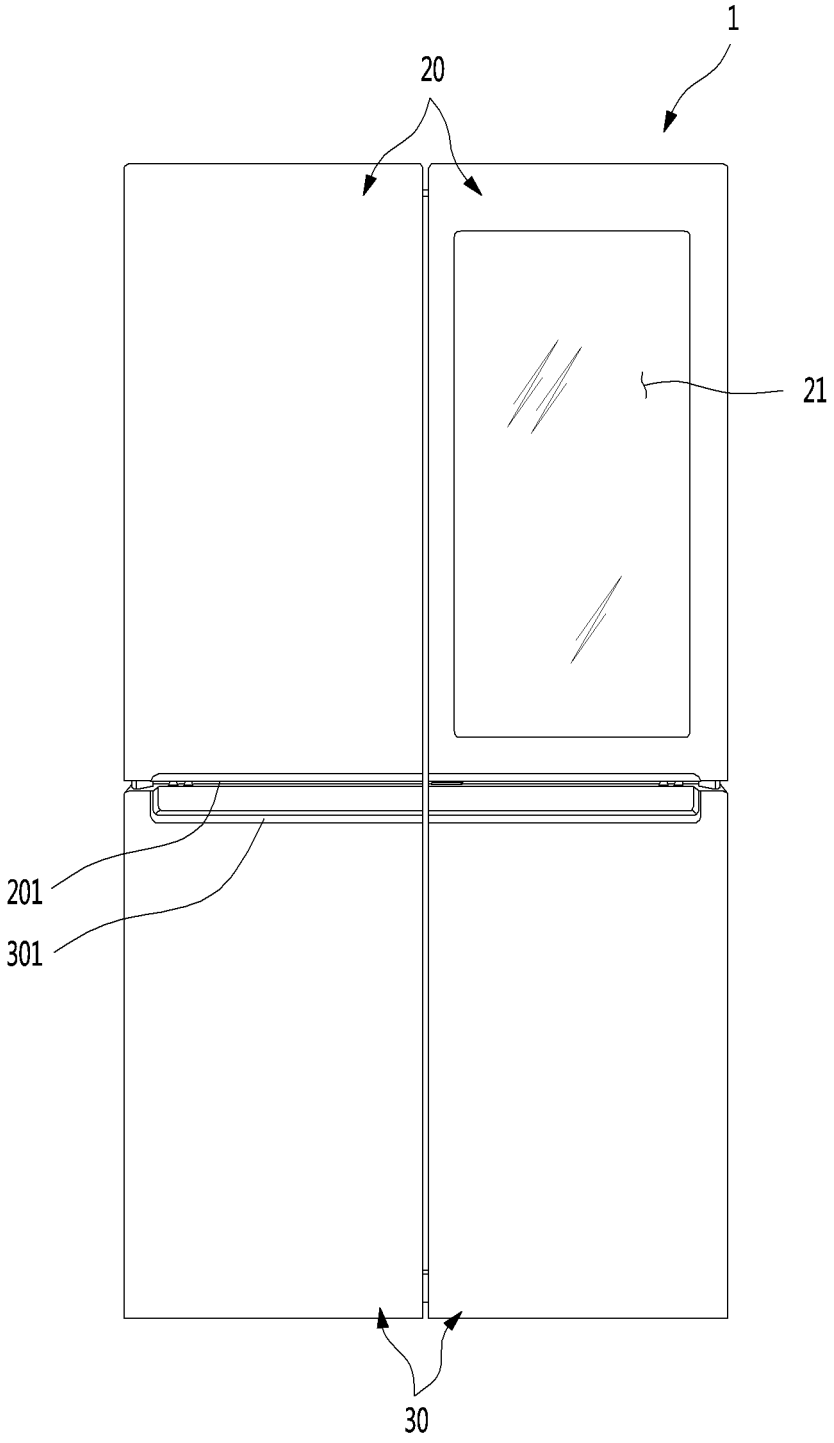
FIG. 1 is a front view of a refrigerator according to an embodiment of the present disclosure.
Figure 2:
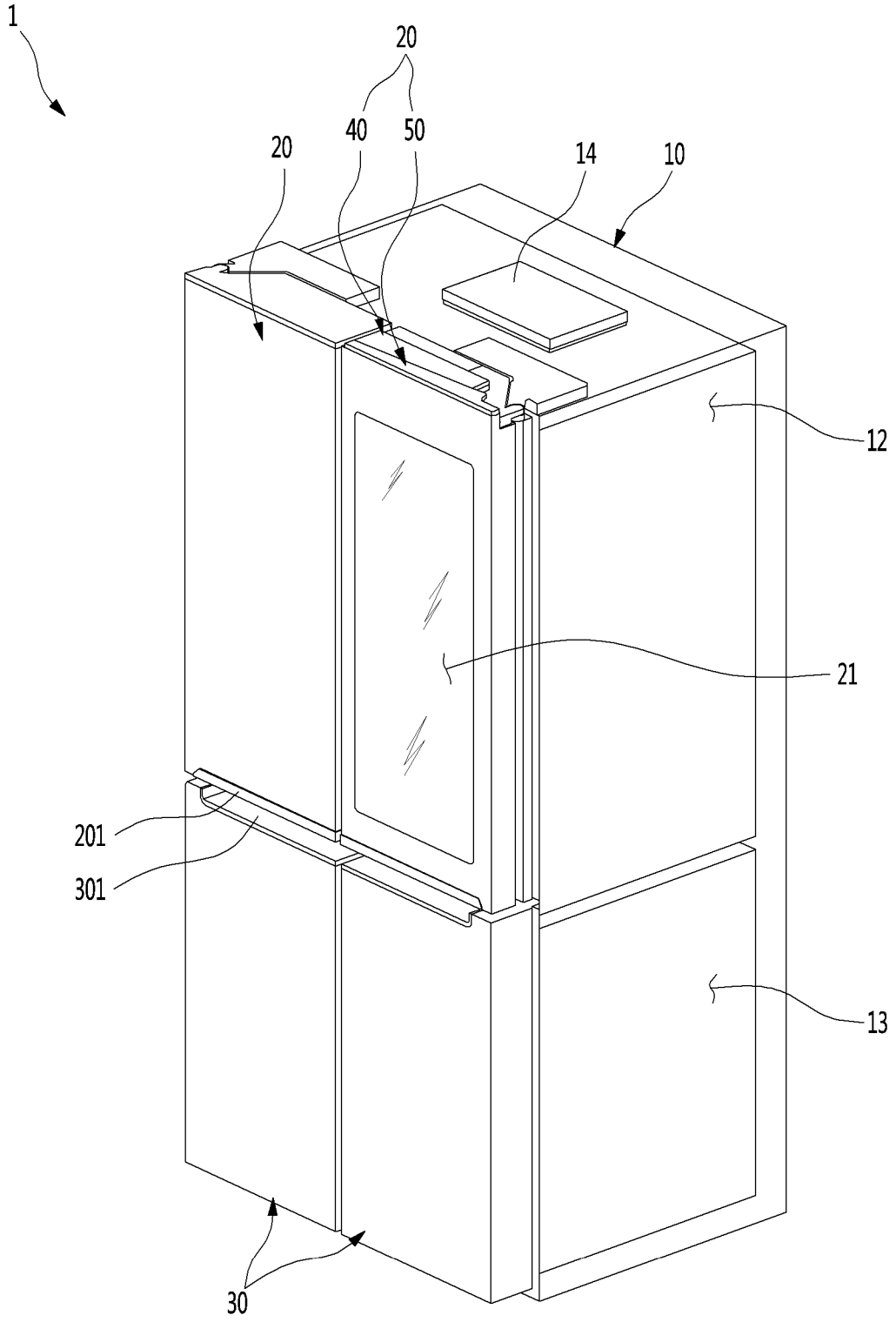
FIG. 2 is a perspective view of the refrigerator.

Referring to FIGS. 1 and 2, the refrigerator 1 according to an embodiment may define an exterior by a cabinet 10 having a storage space formed therein, and a door to open and close the storage space.

The inside of the cabinet 10 may be comparted into an upper part and a lower part by a barrier 11 (see FIG. 4), and a refrigerator compartment 12 may be formed in the upper part of the cabinet 10, and a freezer compartment 13 may be formed in the lower part of the cabinet 10.

A main controller 14 may be provided on an upper surface of the cabinet 10 to control an overall operation of the refrigerator 10. The main controller 14 may be configured to control not only a cooling operation of the refrigerator 10 but also electronic components to provide selective transparency of a transparent unit 21 and to output a screen.

The door may include a refrigerator compartment door 20 and a freezer compartment door 30. The refrigerator compartment door 20 may be configured to open and close an opened front side of the refrigerator compartment 12 by pivoting, and the freezer compartment door 30 may be configured to open and close an opened front side of the freezer compartment 13 by pivoting.

The refrigerator compartment door 20 may include one pair of left and right doors which are configured to open and close the refrigerator compartment 12. In addition, the freezer compartment door 30 may include one pair of left and right doors which are configured to open and close the freezer compartment 13. The freezer compartment door 30 may be configured in a drawer type to be drawn out when necessary, and may include one or more doors.

Handle recesses 201, 301 may be formed on a lower end of the refrigerator compartment door 20 and an upper end of the freezer compartment door 30, respectively. A user may put a hand into the handle recess 201, 301 and may open and close the refrigerator compartment door 20 or the freezer compartment door 30.

A door on at least one side may be formed to make the inside of the refrigerator visible. The refrigerator compartment door 20 may include the transparent unit 21 through which a storage space on a rear surface of the door and/or an inner space of the refrigerator is visible. The transparent unit 21 may define at least part of the front surface of the refrigerator compartment door 20. The transparent unit 21 may be selectively in a transparent state or an opaque state according to user's operation, and the user may exactly identify food stored in the inside of the refrigerator through the transparent unit 21.

The transparent unit 21 may be provided in an opening of the refrigerator compartment door 20. In the present embodiment, it is illustrated that the transparent unit 21 is formed on the refrigerator compartment door 20, but the transparent unit 210 may be provided on refrigerator doors of other forms including the freezer compartment door 30 according to a structure and a shape of the refrigerator.

Figure 3:
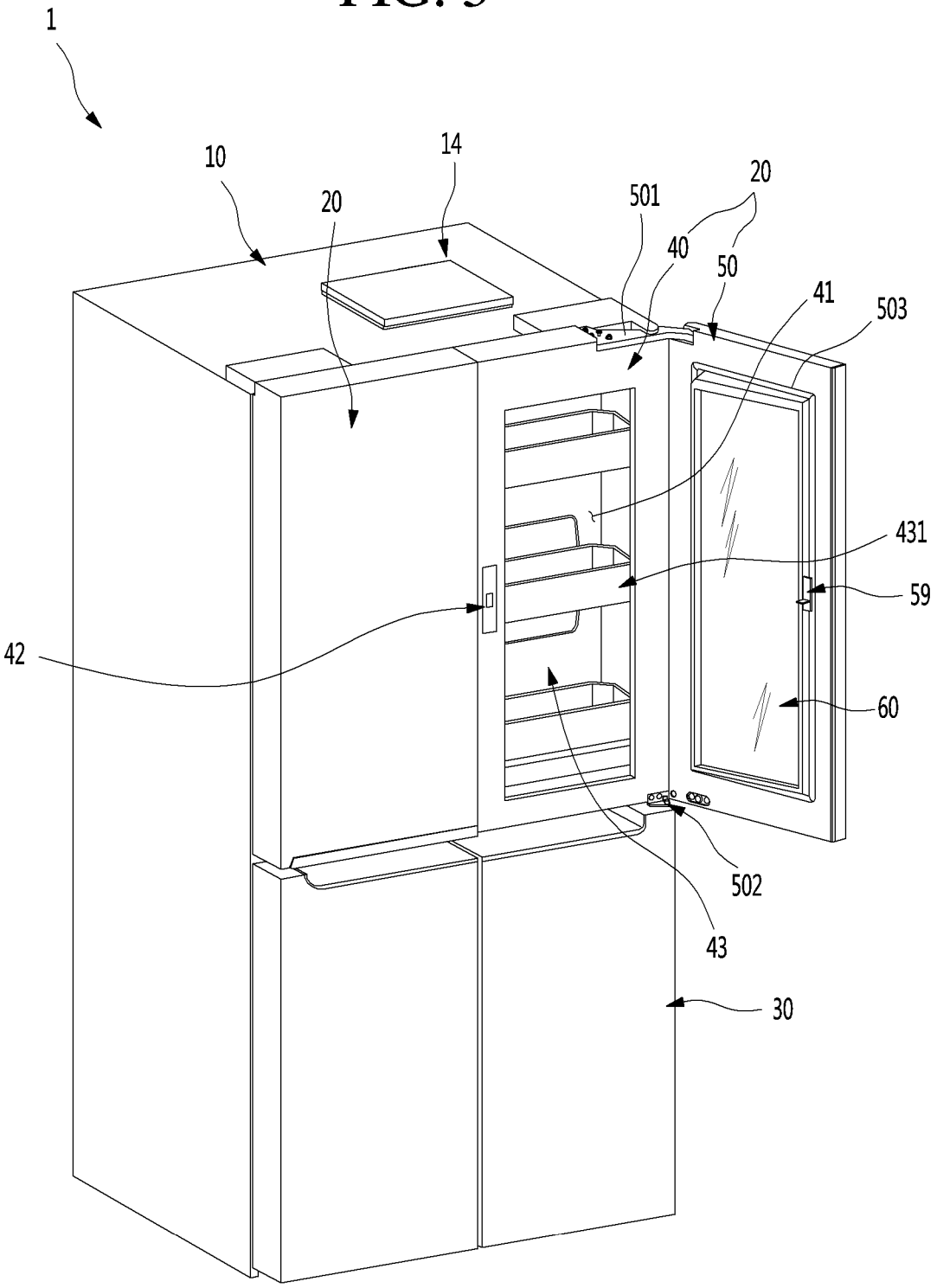
FIG. 3 is a perspective view of the refrigerator a sub door of which is opened.
Figure 4:
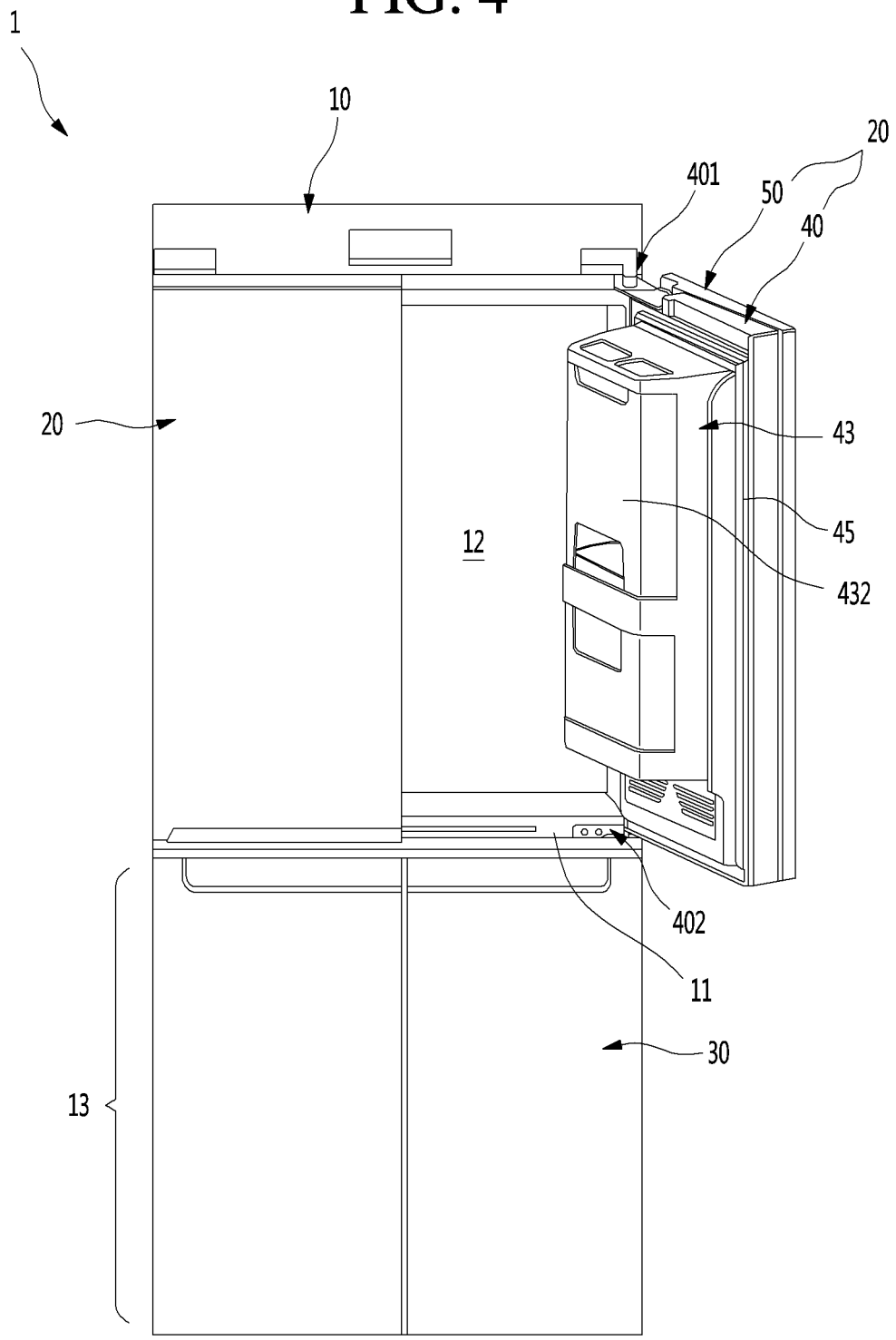
FIG. 4 is a perspective view of the refrigerator a main door of which is opened.

Referring to FIGS. 3 and 4, the refrigerator compartment door 20 on the right (when seen in FIG. 3) of the one pair of refrigerator compartment doors 20 may be configured to be opened and closed in the form of double doors. Specifically, the refrigerator compartment door 20 may include a main door 40 to open and close the refrigerator compartment 12, and a sub door 50 pivotably disposed on the main door 40 to open and close a through hole 41 formed on the main door 40.

The main door 40 may have the same size as that of the refrigerator compartment door 20 on the left (when seen in FIG. 1) of the one pair of refrigerator compartment doors 20, and may be pivotably mounted on the cabinet 10 by means of an upper hinge 401 and a lower hinge 402, and may open and close at least part of the refrigerator compartment 12.

The through hole 41 of a predetermined size may be formed on the main door 40. A door basket 431 may be mounted on a rear surface of the main door 40 including an inside of the through hole 41. In this case, a size of the through hole 41 may be formed occupy most of the front surface of the main door 40 except for a part of the border of the main door 40.

A main gasket 45 may be formed along the border of the rear surface of the main door 40 to prevent leakage of cool air from the inner space of the cabinet 10 when the main door 40 is closed. The sub door 50 may be pivotably mounted on the front surface of the main door 40 to open and close the through hole 41. When the sub door 50 is opened, the through hole 41 may be exposed.

The sub door 50 may have the same size as that of the main door 40, and may be configured to cover the entire front surface of the main door 40. A sub gasket 503 may be provided on a rear surface of the sub door 50 to tightly seal between the main door 40 and the sub door 50.

A display assembly 60 may be provided on the center of the sub door 50 to allow the inside to be visible selectively, and also, to output a screen. Accordingly, even when the sub door 50 is closed, the inside of the through hole 41 may be selectively visible, and also, an image may be output. The transparent unit 21 may be defined as a portion on the sub door 50 that allows the inside of the refrigerator to be seen. The display assembly 60 may be referred to as a transparent display assembly.

The display assembly 60 may be configured to change to a transparent state or an opaque state selectively, according to whether internal lights 57 provided in a storage compartment or the door are turned on or off. Accordingly, the display assembly 60 may change to be transparent to allow the inside of the refrigerator to be seen only when the user wants, and may be maintained in the opaque state when the user does not want. In addition, the display assembly 60 may output a screen in the transparent state or the opaque state.

Specifically, the display assembly 60 may be configured to implement a plurality of modes. For example, the display assembly 60 may implement a transparent mode. When the display assembly 60 is in the transparent mode, the internal lights 57 may be turned on and the inner space of the refrigerator may be visible through the display assembly 60. In this case, a display provided on the display assembly 60 may not operate and backlights 68 may be turned off.

In another example, the display assembly 60 may implement an opaque mode. When the display assembly 60 is in the opaque mode, the internal lights 57 may be turned off and the inner space of the refrigerator may be invisible through the display assembly 60. In this case, the display provided on the display assembly 60 may not operate and the backlights 68 may be turned off.

In still another example, the display assembly 60 may implement a display mode. When the display assembly 60 is in the display mode, the internal lights 57 may be turned off. In addition, the display provided on the display assembly 60 may operate and the backlights 68 may be turned on, and predetermined information may be displayed through the display assembly 60.

The display assembly 60 may be in any one state of the three modes described above. In addition, the user may change any one mode to another mode by operating the display assembly 60, for example, by operating (touching) a front panel 61.

A sub upper hinge 501 and a sub lower hinge 502 may be provided on an upper end and a lower end of the sub door 50, respectively, and the sub door 50 may be pivotably mounted on the front surface of the main door 40 through the hinges 501, 502. An opening device 59 may be provided on the sub door 50, and a locking unit 42 may be provided on the main door 40 to correspond to the opening device 59. Accordingly, the sub door 50 may be maintained in a closed state by coupling the opening device 59 and the locking unit 42, and, when the opening device 59 and the locking unit 42 are decoupled from each other by operating the opening device 59, the sub door 50 may pivot to open the through hole 41 of the main door 40.

A damping device 504 (see FIG. 6) may be provided on a lower portion of the sub door 50. The damping device 504 may be disposed adjacent to the sub lower hinge 502 to mitigate a shock when the sub door 50 which is heavy due to the display assembly 60 is closed.

A storage casing 43 may be provided on the rear surface of the main door 40. A plurality of door baskets 431 may be disposed in the storage casing 43, and a casing door 432 may be provided on the storage casing 43 to be openable.

Figure 5:
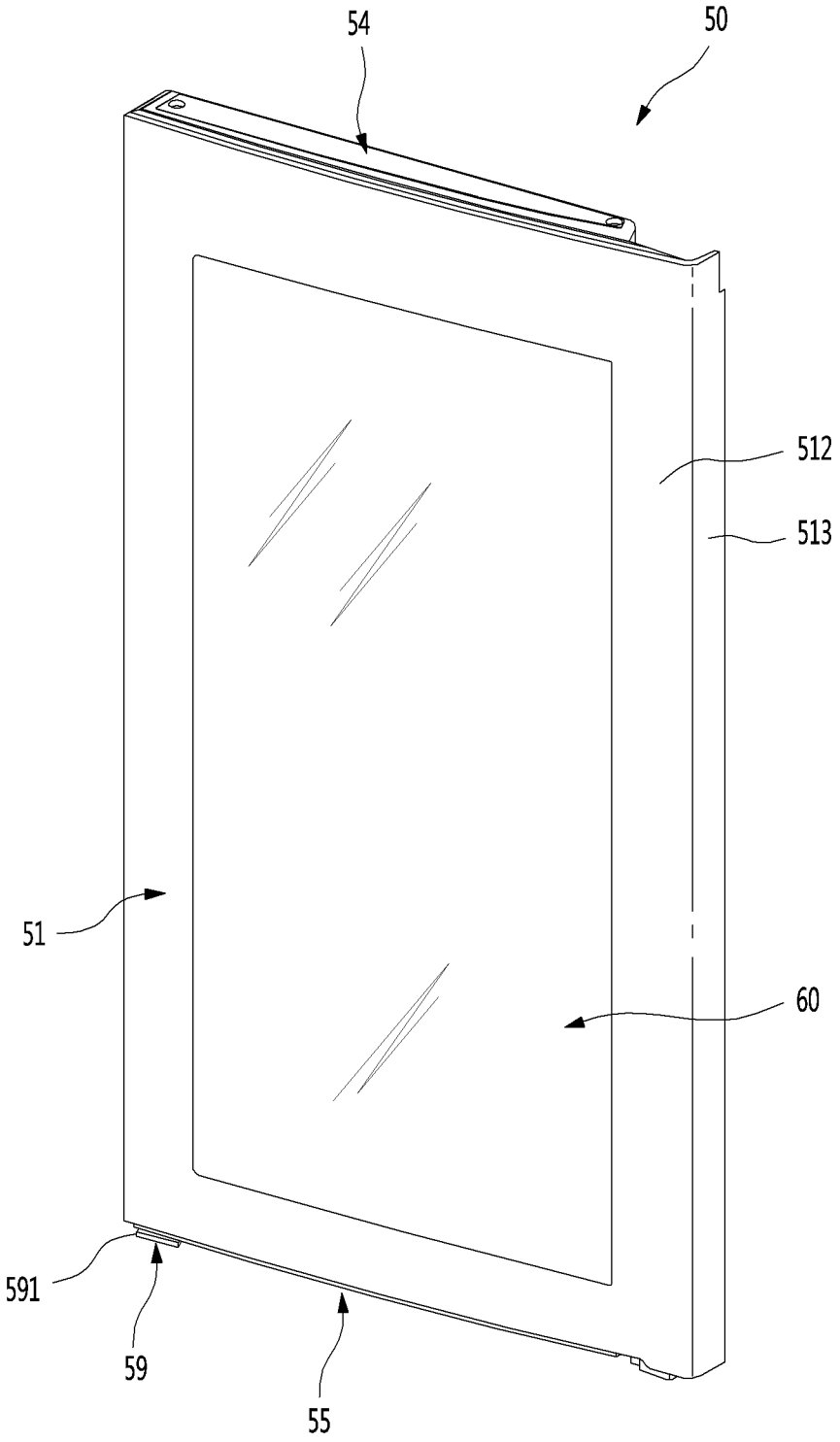
FIG. 5 is a perspective view of the sub door as seen from the front.
Figure 6:
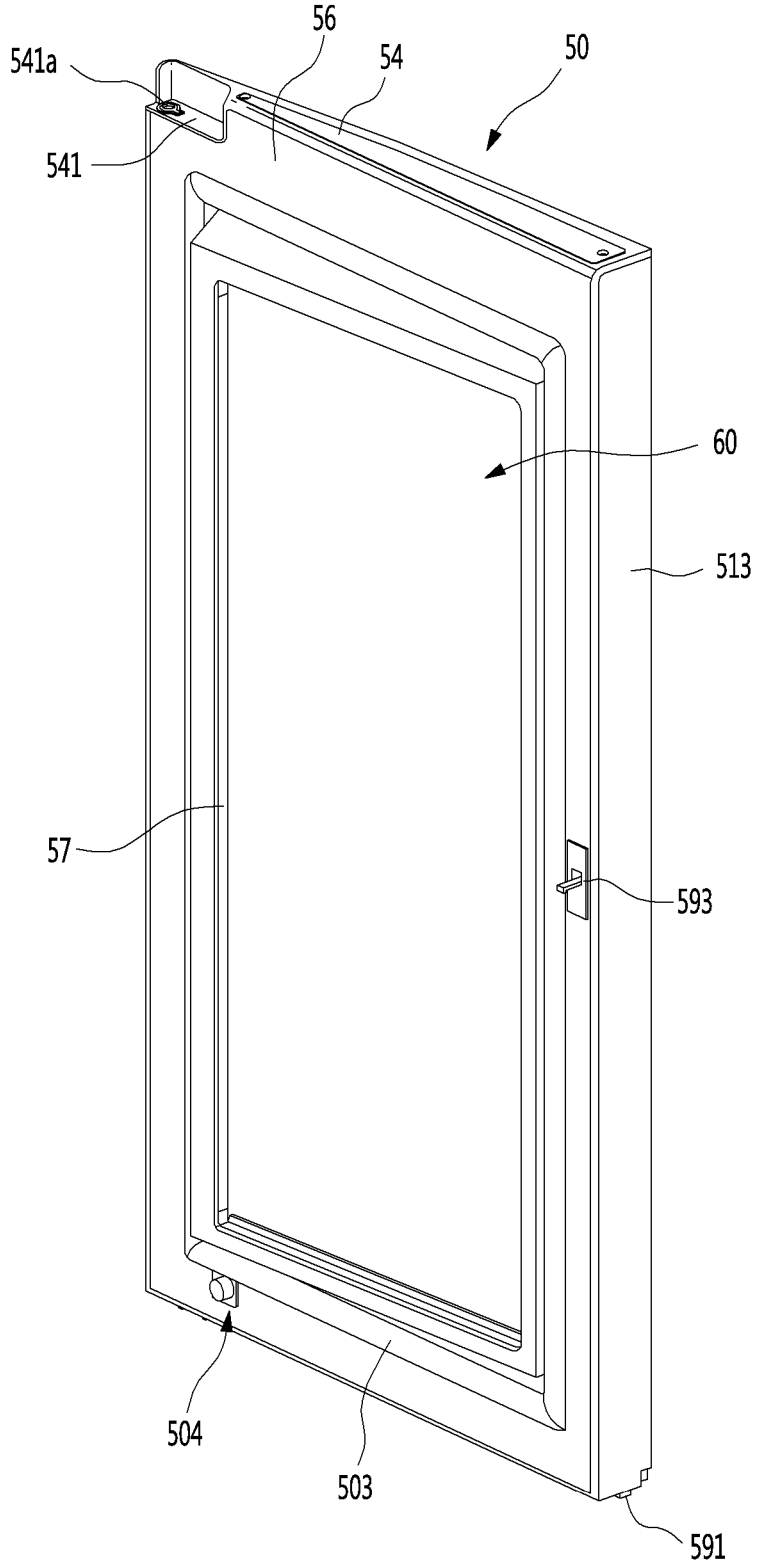
FIG. 6 is a perspective view of the sub door as seen from the rear.
Figure 7:
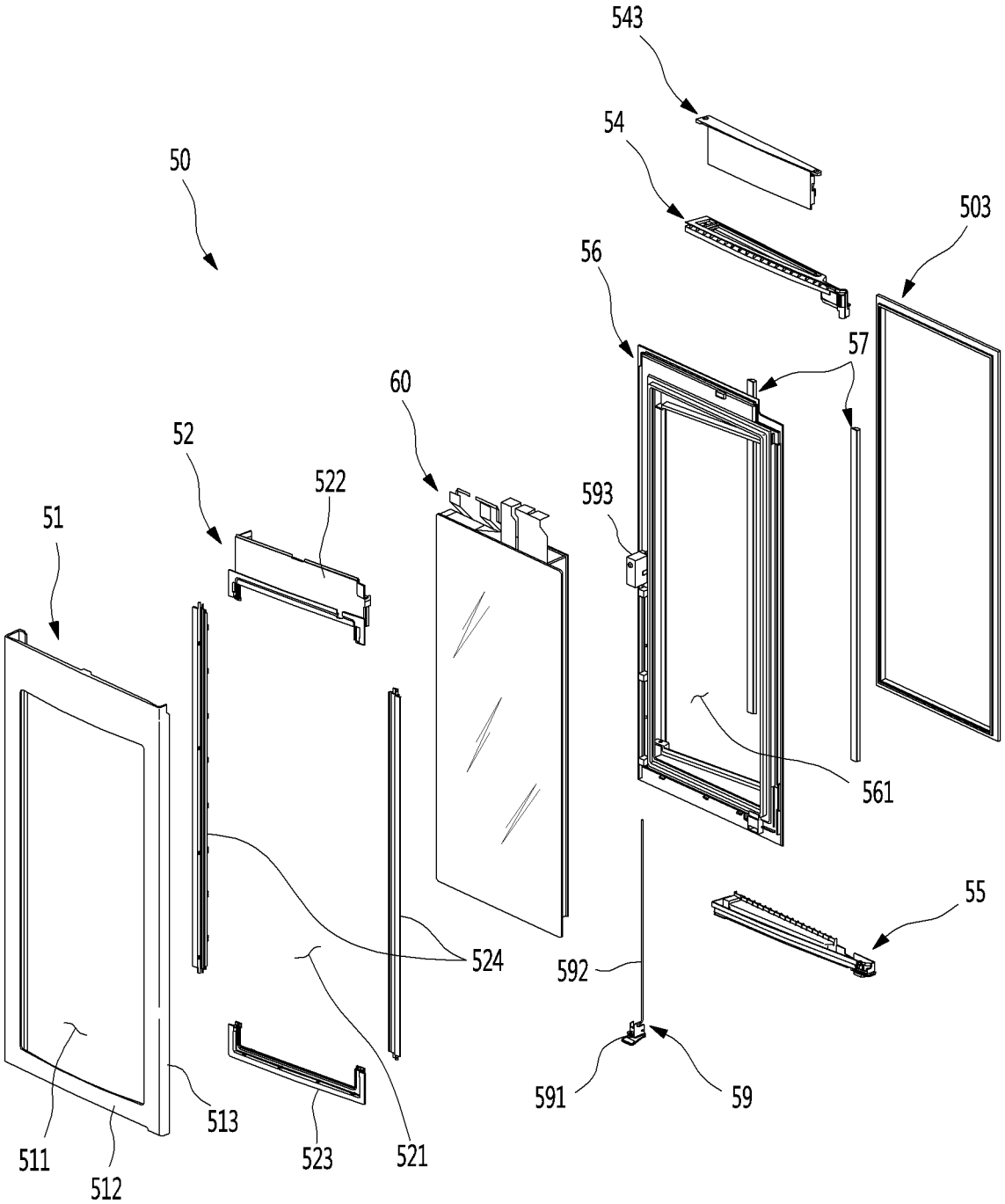
FIG. 7 is an exploded perspective view of the sub door.

Referring to FIGS. 5 to 7, the sub door 50 according to an embodiment may include an outer plate 51 defining an exterior, a door liner 56 mounted on the outer plate 51, spaced apart therefrom, and the display assembly 60 mounted in openings of the outer plate 51 and the door liner 56. In addition, the sub door 50 may further include an upper cap decoration 54 and a lower cap decoration 55 defining an upper surface and a lower surface of the sub door 50, respectively.

The outer plate 51 may define a part of the exterior of the front surface and the circumference surface of the sub door 50, and may be formed with a plate-shaped stainless material. The outer plate 51 may be formed with the same material as the refrigerator compartment door 50 and the freezer compartment door 30. Various surface treatments, such as anti-fingerprint coating, hairline, coating for implementing a color or a pattern, or film attachment, may be performed on the front surface of the outer plate 51.

The outer plate 51 may have a rectangular frame shape having an opening penetrating through the center thereof. Specifically, the outer plate 51 may include a front surface portion 512 defining the exterior of the front surface, and side surface portions 513 defining exteriors of side surfaces and bending backward from both ends of the front surface portion 512.

A plate opening 511 may be formed on the center of the front surface portion 512, and the plate opening 51 may be covered by the display assembly 60. Since the inside of the refrigerator is visible through the display assembly 60, an inner region of the plate opening 511 may be referred to as the transparent unit 21.

The upper cap decoration 54 and the lower cap decoration 55 may be coupled to the upper end and the lower end of the outer plate 51, respectively. In addition, the side surface portions 513 may be coupled with the door liner 56. Accordingly, the outer plate 51 may define the exterior of the sub door 50 by being coupled with the door liner 56 and the upper cap decoration 54 and the lower cap decoration 55.

The door liner 56 may define the rear surface of the sub door 50, and may have a liner opening 561 to correspond a region where the door assembly 60 is disposed. In addition, the sub gasket 503 may be mounted on a rear surface of the door liner 56 to tightly seal between the sub door 50 and the main door 40.

The internal lights 57 may be provided on both sides of the liner opening 561. The internal lights 57 may be configured to light the rear surface of the sub door 50 and the rear portion of the display assembly 60.

The internal lights 57 may light the inner space of the storage casing 43. Specifically, when the internal lights 57 are turned on, the inside of the storage casing 43 may be lightened, and as a result, the inside of the refrigerator may be lighter than the outside of the refrigerator, and the inside of the refrigerator is visible through the display assembly 60.

The internal lights 57 may be disposed on both sides of the display assembly 60 to face each other. However, the internal lights 57 may be mounted on various positions as long as the internal lights 57 have brightness sufficient to light the rear portion of the sub door 50.

The opening device 59 may be mounted on the door liner 56. The opening device 59 may include an operation member 591 exposed from a lower end of the sub door 50, a rod 592 extended from the operation member 591, and a locking member 593 protruding from the rear surface of the door liner 56. When the user operates the operation member 591, the rod 592 may move the locking member 593 and the sub door 50 may be decoupled from the main door 40, and the sub door 50 may be opened.

The upper cap decoration 54 may define the upper surface of the sub door 50 and may be coupled to upper ends of the outer plate 51 and the door liner 56. In addition, a mounting portion 541 of the sub upper hinge may be formed on the upper cap decoration 54, and a hinge hole **541*a* may be formed on the mounting portion 541 of the sub upper hinge to allow a hinge shaft of the sub upper hinge 501 to be inserted thereinto. The lower cap decoration 55 may define the lower surface of the sub door 50, and may be coupled to lower ends of the outer plate 51 and the door liner 56**.

The display assembly 60 may be disposed between the outer plate 51 and the door liner 56, and may be configured to cover the plate opening 511 and the door liner opening 561. In addition, the display assembly 60 may be selectively operated in any one of a transparent state, a translucent state, an opaque state, and a screen output state. Accordingly, the user can selectively see the inner space of the sub door 50 through the display assembly 60, and also, can see a screen outputted through the display assembly 60.

An inner frame 52 may be mounted on the circumference of the plate opening 511 of the outer plate 51 to support the display assembly 60. The display assembly 60 may be fixed to the outer plate 51 by the inner frame 52.

A frame opening 521 may be formed in the center of the inner frame 52, and may be formed to be smaller than the plate opening 511, thereby providing a structure to allow the display assembly 60 to be seated therein. In addition, the frame opening 521 may be formed to be smaller than the front panel 61, and larger than a rear panel 65. Accordingly, when the display assembly 60 is mounted, the rear panel 65 may be seated on the door liner 56 by passing through the plate opening 511 and the frame opening 521 in sequence.

When the display assembly 60 is mounted, the inner frame 52 may support the rear surface of the border of the outer plate 51 and the rear surface of the border of the display assembly 60, simultaneously, and the front surface of the outer plate 51 and the front surface of the display assembly 60 which are adjacent to each other may be positioned on the same plane with a stepped portion therebetween.

Figure 8:
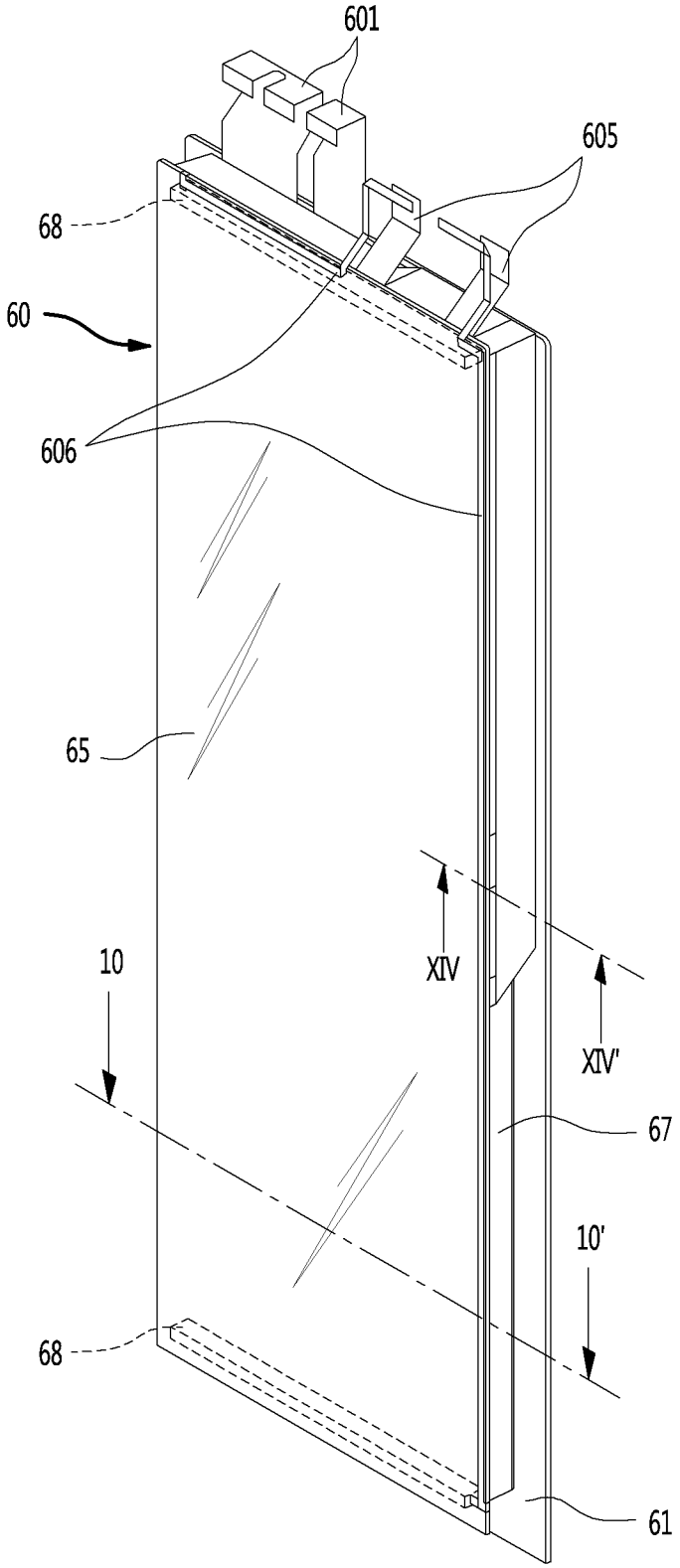
FIG. 8 is a perspective view of a display assembly according to an embodiment of the present disclosure.
Figure 9:
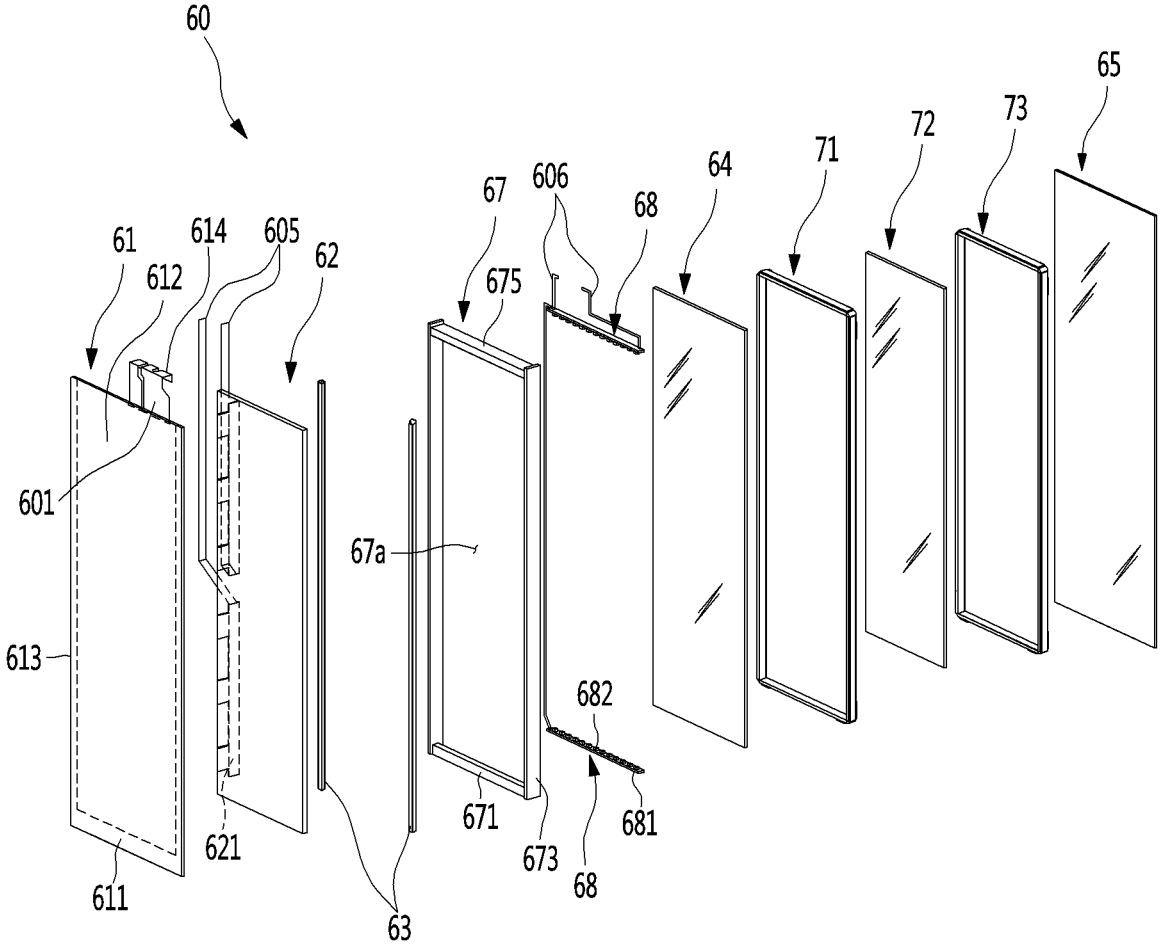
FIG. 9 is an exploded perspective view of the display assembly.
Figure 10:
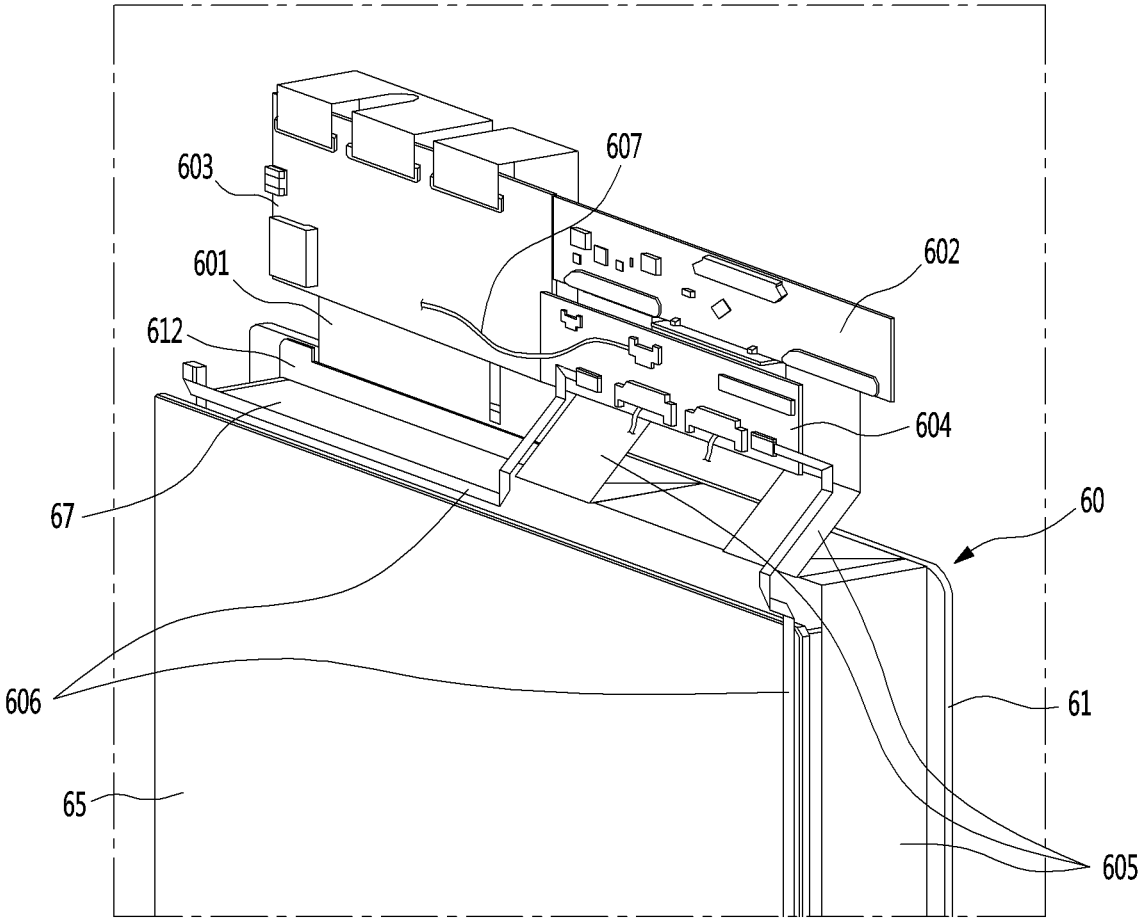
FIG. 10 is a partial perspective view showing a PCB disposed on an upper portion of the display assembly.
Figure 11:
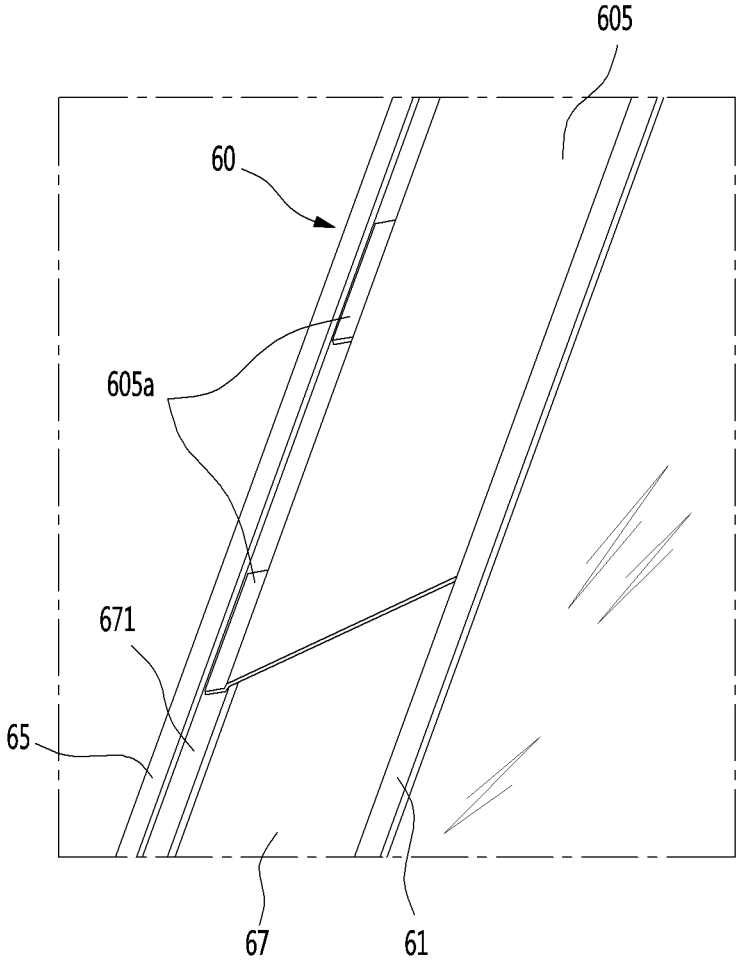
FIG. 11 is a partial perspective view showing a display cable disposed on the display assembly.
Figure 12:
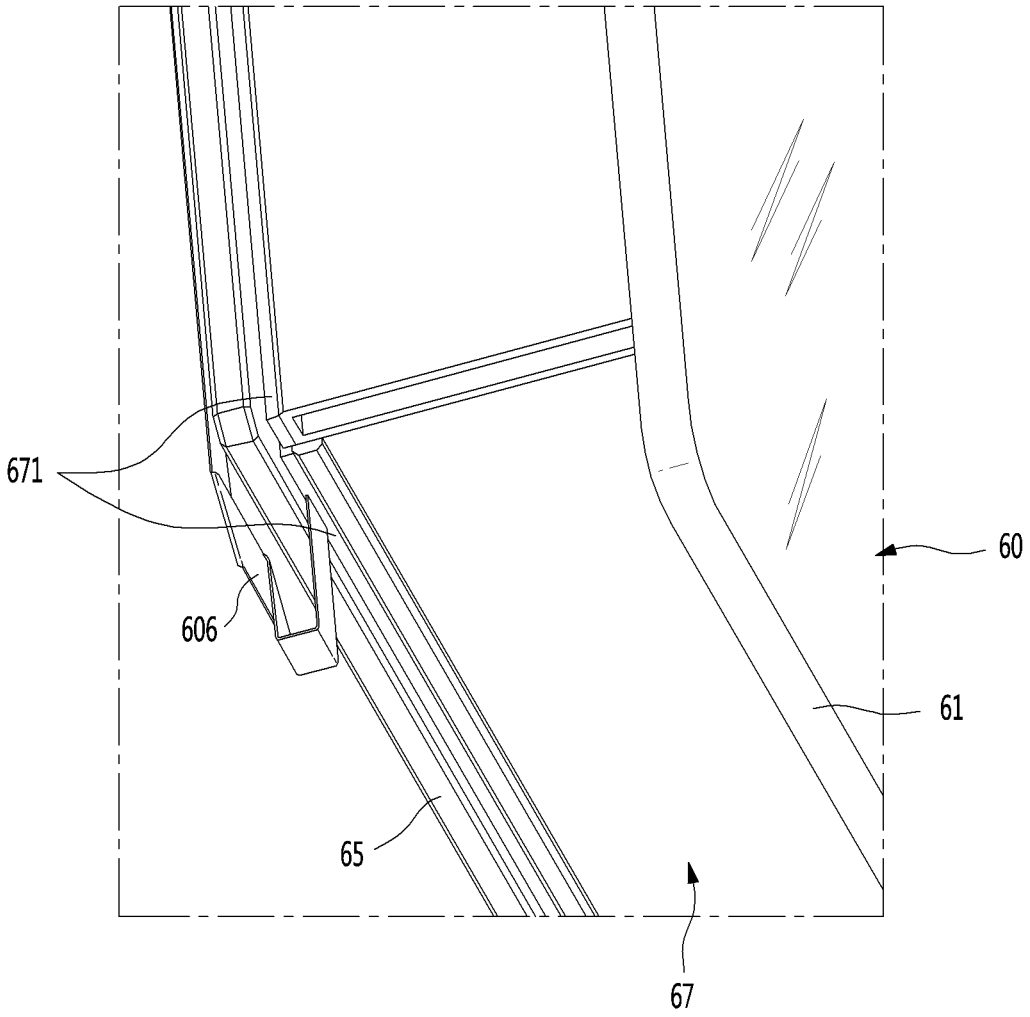
FIG. 12 is a partial perspective view showing a backlight cable disposed on the display assembly.
Figure 13:
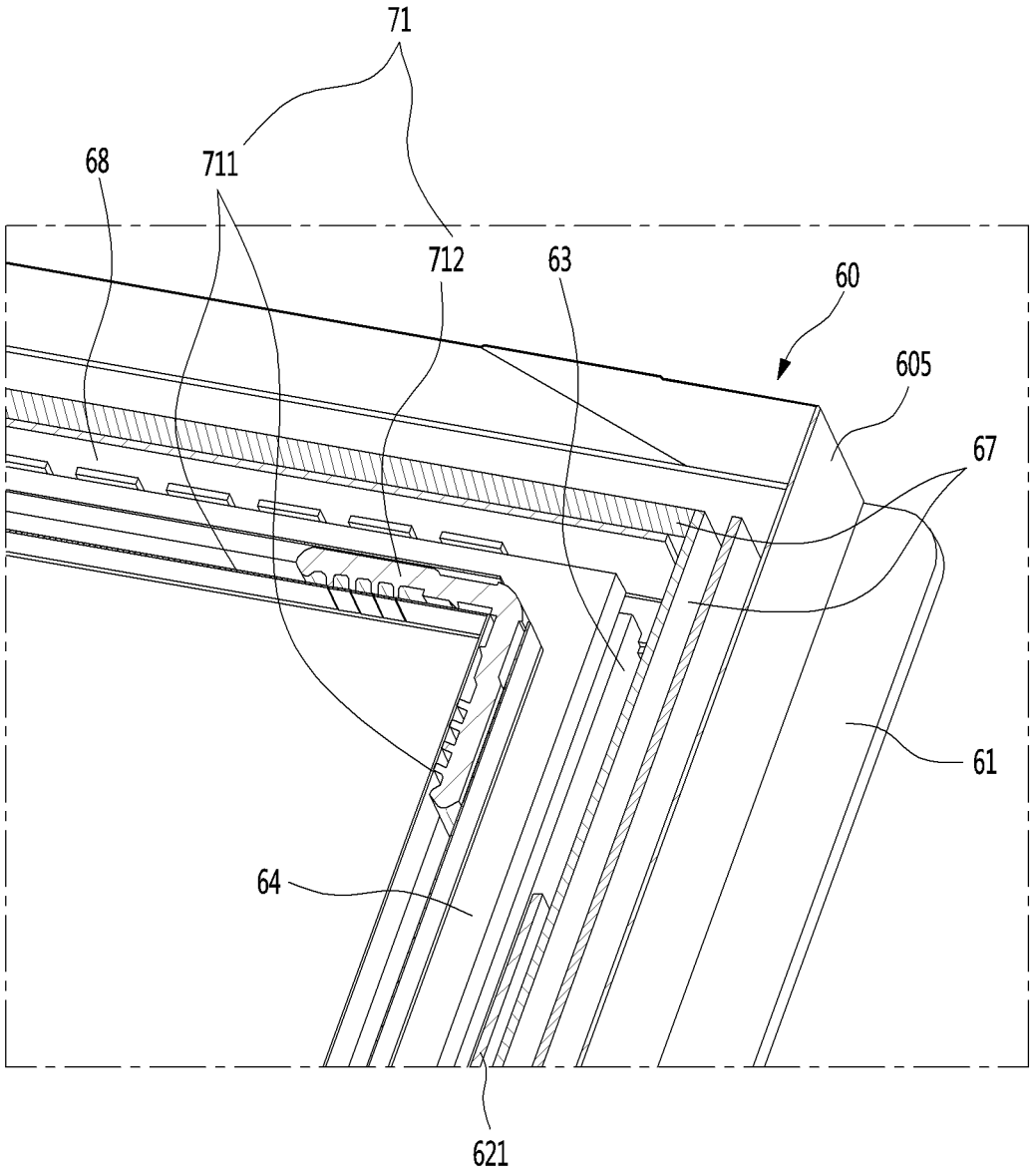
FIG. 13 is a partial cutaway perspective view of the display assembly.
Figure 14:
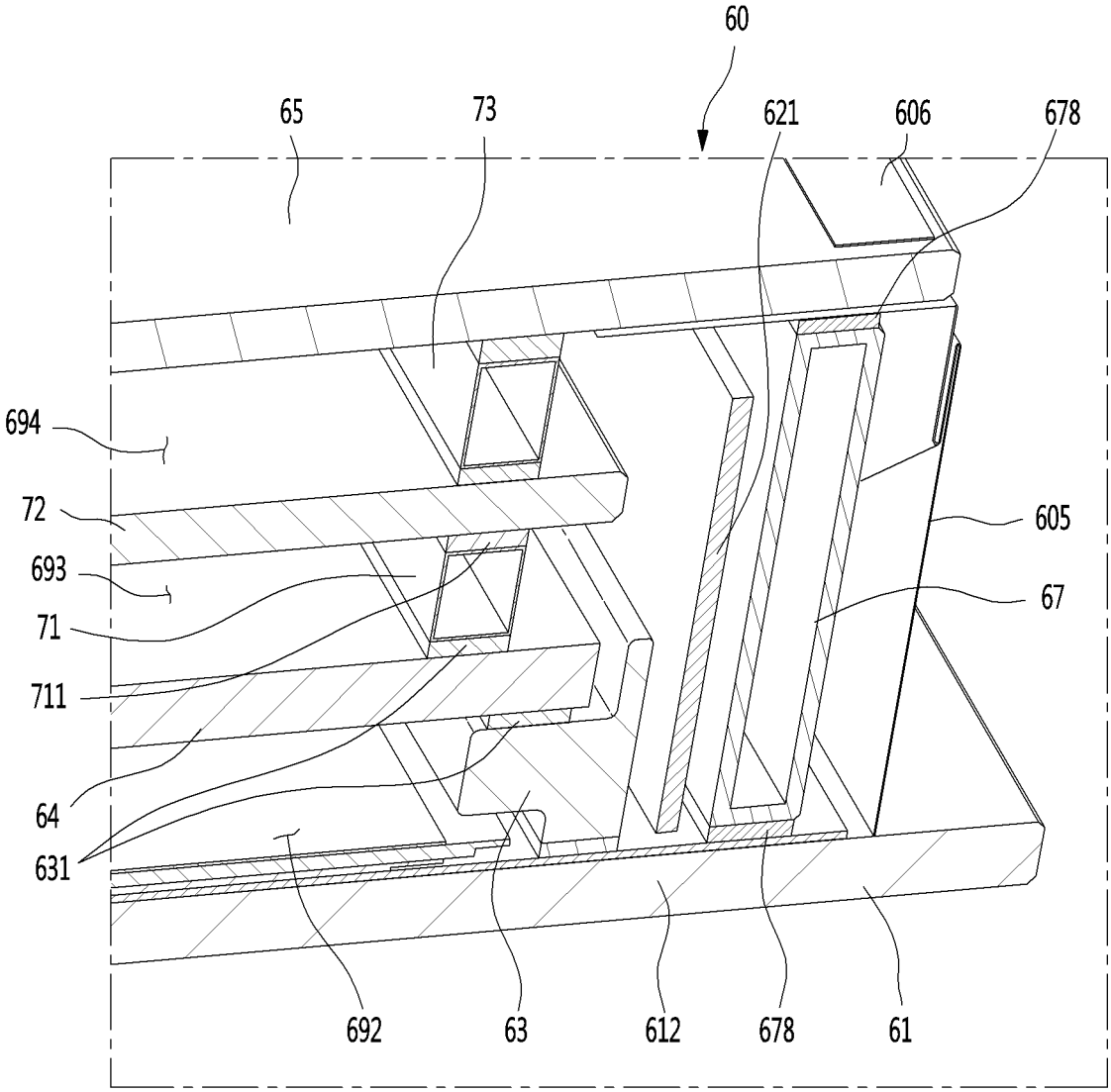
FIG. 14 is a cross-sectional view taken on line XIV-XIV' of FIG. 8.

Referring to FIGS. 8 and 9, the display assembly 60 may have a size to cover the plate opening 511 and the liner opening 561 inside the sub door 50, and may define the transparent unit 21 to allow the inner space of the refrigerator to be visible selectively, and may cause a screen to be outputted. The display assembly 60 may define an exterior by means of the front panel 61 and the rear panel 65 which define the front surface and the rear surface of the assembly 60, and an outer spacer 67 connecting between the front panel 61 and the rear panel 65. The outer spacer 67 may space the front panel 61 and the rear panel 65 apart from each other, and may have an insulation space formed therein.

The outer spacer 67 may include a conductive component. For example, the outer spacer 67 may be formed with an aluminum material. In another example, the outer spacer 67 may be formed by performing aluminum coating on a surface of a synthesis resin. The synthesis resin may include polyvinyl chloride (PVC).

In still another example, the outer spacer 67 may be formed with a non-conductive material and may reduce an influence of electromagnetic waves acting in the outer spacer 67. For example, the outer spacer 67 may be formed with a plastic material.

The outer spacer 67 may have a rectangular frame shape. Specifically, the outer spacer 67 may include a first portion (or bottom spacer) 671, two third portions (or side spacers) 673 extended upward from both sides of the first portion 671, and a second portion (or top spacer) 675 connecting the two third portions 673. In addition, the outer spacer 67 may have a spacer opening 67*a* penetrating therethrough. A display 62, a light guide plate 64, an insulation panel 72, and first to third spacers 63, 71, 73 may be arranged in the spacer opening 67*a*.

The display assembly 60 may further include the display 62 and the light guide plate 64 provided between the front panel 61 and the rear panel 65, the first spacer 63 to support the display 62 and the light guide plate 64, and the backlights 68 to emit light toward the light guide plate 64. The backlight 68 may include a substrate 681 and a plurality of light emitting diodes (LEDs) 682 installed in the substrate 681.

More specifically, the front panel 61 may define the exterior of the front surface of the display assembly 60, and may be formed with a transparent glass material. The front panel 61 may be formed with other materials that can allow the inside to be visible therethrough, and enables a touch input.

Specifically, the front panel 61 may be formed with a material such as transparent blue glass to allow the inside to be visible therethrough, and a touch sensor 612 may be attached to the front panel 61 to detect an input for operating the display 62. The touch sensor 612 may be provided on a rear surface of the front panel 61 in a printing method. The touch sensor 612 may be provided by a film attachment method, not by the printing method. When the user touches a surface of the front panel 61, the touch sensor 612 may recognize this and may generate a signal for operating the display 62 or the refrigerator 1.

The front panel 61 may be formed to be larger than the plate opening 511, and may be supported by the inner frame 52. That is, when the display assembly 60 is mounted from the rear portion to be assembled, the rear surface of the border of the front panel 61 may be supported on the front surface of the inner frame 52.

Specifically, the front panel 61 may include a front protrusion 613 further protruding outward than the rear panel 65. The front protrusion 613 may be formed to be longer than the rear panel 65 in the vertical direction and the horizontal direction, and may be supported by the inner frame 52.

A bezel 611 may be formed along the border of the front panel 61. The bezel 611 may be defined as an outside of the transparent unit 21 or an outside of the outer spacer 67. Even when the internal lights 57 are turned on and are driven and the inside of the refrigerator is visible through the transparent unit 21, transparency may be limited to an area within the bezel 611.

The bezel 611 may be implemented on the front panel 611 by a silk screen printing method. For example, the bezel 611 may be formed by screen printing with black color. The bezel 611 may be implemented by other methods as long as penetration of light is limited.

The bezel 611 may be formed on the rear surface of the front panel 61. However, this should not be considered as limiting, and the bezel 611 may be formed on the front surface of the front panel 61. The bezel 611 may be configured to have a predetermined width on the border of the front panel 61, and the outer spacer 67 and the first spacer 63 may not be exposed to the outside due to the bezel 611.

A touch cable 601 may be provided on an upper portion of the front panel 61 to be connected with the touch sensor 612. The touch cable 601 may be configured by a cable of a flexible film type, such as a flexible flat cable (FFC), a flexible print cable (FPC), or a flexible print circuit board, and may be configured to be connected with a touch printed circuit board (PCB) 603.

The display 62 may be configured to allow the user to easily check the inside of the refrigerator through the display assembly 60 from the outside of the refrigerator. The display 62 may be provided on the rear surface of the front panel 61. The display 62 may include a liquid crystal display (LCD) module for outputting a screen, and may be configured to be transparent to allow the inside to be visible when a screen is not output. The display 62 may be configured by an organic light emitting diode (OLED) and other various display modules.

A source board 621 may be provided at one side of both left and right sides of the display 62 as a display PCB. The source board 621 may be driven to output a screen of the display 62, and may form one assembly with the display 62. At least part of the source board 621 may include a cable of a flexible film type, and the cable may be extended upward along a side surface of the display assembly 60 in a bent state.

The source board 621 may be disposed on an inner surface of the outer spacer 67, and may be disposed in a space between the outer spacer 67 and the first spacer 63. Display cables 605 may be connected to the source board 621 and may be connected to a T-CON board 602 on an upper portion of the sub door 50.

When the source board 621 is disposed on the rear surface of the display 62, the source board 621 may be exposed to the outside through the transparent unit 21 due to the transparent characteristic of the display 62. In addition, when the source board 621 has a structure protruding to the side, there is a problem that the size of the sub door 50 increases.

Therefore, the source board 621 may be disposed on an end of the border of the display 62, and may be bent to be in contact with an inner surface 673*a* (see FIG. 16) of the outer spacer 67. For example, the inner surface 673*a* may be an inner surface of the third portion 673 of the outer spacer.

The source board 621 may include two parts, an upper part and a lower part, which are connected to one pair of display cables 605, respectively. The display cables 605 may have a flexible and flat structure like the touch cable 601, and may be freely bendable.

The display cables 605 may be extended from the source board 621 to the side, and then may be bent to be extended along the border surface of the display assembly 60. In addition, the display cables 605 may be extended upward and may be coupled with the T-CON board 602 on the upper portion of the sub door 50.

The T-CON board 602 (timing controller) is a PCB which processes an input image signal and transmits the image signal to the source board 621, and may perform a function of adjusting a timing of the image signal. An afterimage (blurring phenomenon) on a screen can be prevented by the T-CON board 602.

The first spacer 63 may be formed in a rod or bar shape extended from an upper end of the display 62 to a lower end, and one pair of first spacers 63 may be provided to support both left and right sides of the display 62. The first spacer 63 may be formed with an aluminum material, and the display 62 and the light guide plate 64 may maintain a predetermined gap therebetween by the first spacer 63.

The light guide plate 64 may be positioned behind the display, and may be supported by the one pair of first spacers 63 and may be spaced apart from the display 62 by a predetermined distance. There may be a difference in the sense of depth of a screen outputted from the display 62 according to a position of the light guide plate 64.

The light guide plate 64 may be positioned closer to the front than the center point between the front panel 61 and the rear panel 65, such that the user can feel a screen outputted from the display 62 closer to the front panel 612, and in response to this, a height of the first spacer 63 may be determined.

The light guide plate 64 may guide light emitted from the backlights 68 toward the display 62, and may be formed with a polymer material, for example, and may have a pattern formed on a surface thereof or a film attached to a surface thereof. The light guide plate 64 may be configured to light the rear portion of the display 62 when the backlights 68 are turned on. To achieve this, the light guide plate 64 may be formed in a plate shape having the same size as that of the display 62 or a larger size. The backlights 68 may be provided on positions corresponding to the upper end and the lower end of the light guide plate 64.

The rear panel 65 may be disposed behind the light guide plate 64. The rear panel 65 may define the rear surface of the display assembly 60 and may be formed to be larger than the light guide plate 64 and smaller than the front panel 61. In addition, the rear panel 65 may be formed to be larger than the liner opening 561 and may cover the liner opening 561.

The second spacer 71 of a rectangular frame shape may be disposed on a rear surface of the light guide plate 64 along the border of the light guide plate 64, and the insulation panel 72 may maintain a predetermined gap with the light guide plate 64 by the second spacer 71. The insulation panel 72 may be formed with the same insulation glass as the rear panel 65. The third spacer 73 may be disposed on a rear surface of the insulation panel 72, and the rear panel 65 may be attached to the rear surface of the third spacer 73 to maintain a predetermined gap between the insulation panel 72 and the rear panel 65.

The rear panel 65 may be attached to the outer spacer 67, and may be fixed while maintaining a predetermined gap with the front panel 61. In addition, the display 62, the first spacer 63, the light guide plate 64, the second spacer 71, the insulation panel 72, and the third spacer 73 may be arranged in sequence in the inner region of the outer spacer 76 between the front panel 61 and the rear panel 65, that is, in the spacer opening 67*a*.

The rear panel 65 may be in contact with the internal lights 57, and a distance between the display 62 and the internal light 57 may be determined according to a position of the rear panel 65. The internal lights 57 may perform an auxiliary backlight function of the display 62 when being turned on.

The outer spacer 67 may connect the rear surface of the front panel 61 and the front surface of the rear panel 65, and simultaneously, may define the circumference surface of the display assembly 60. In addition, mounting portions of the backlights 68 may be formed on an inner surface of the outer spacer 67, that is, inner surfaces of the first portion 671 and the second portion 675 of the outer spacer.

The light guide plate 64 may be positioned between the backlights 68 disposed on the upper end and the lower end of the outer spacer 67. Accordingly, light emitted from the backlights 68 may be directed toward ends of the light guide plate 64 and may travel along the light guide plate 64, and the light may be emitted from the entire surface of the light guide plate 64.

The backlights 68 may be connected with backlight cables 606. The backlight cables 606 may be formed in a flexible and flat structure like the touch cable 601 and the display cables 605.

In addition, the backlight cables 606 may be extended along the border of the display 62 not to be exposed through the transparent display 62. The backlight cables 606 may be extended upward in contact with the rear surface of the rear panel 65, and may be bent in contact with the rear surface of the rear panel 65 and may be connected with a docking PCB 604 on an upper portion of the sub door 50.

The docking PCB 604 may be understood as a PCB for electrically connecting the main controller 14 and the display assembly 60, and may have a connection cable 670 coupled thereto. The connection cable 607 may be extended from the docking PCB 604 toward the main controller 14. In addition, the docking PCB 604 may be connected with at least one of the touch PCB 603 and the T-CON board 602.

Referring to FIGS. 10 to 14, the plurality of PCBs 602, 603, 604 may be installed in a space between the upper portion of the sub door 50, that is, the upper end of the display assembly 60, and the upper cap decoration 54, to drive the display assembly 60.

The PCBs may include the T-CON board 602, the touch PCB 603, and the docking PCB 604. The cables 601, 605, 606 connecting the plurality of PCBs 602, 603, 604 may be configured by an FFC or an FPC of a flexible film type. The cables 601, 605, 606 may include the touch cable 601, the display cables 605, and the backlight cables 606, and these cables may not occupy more spaces inside the sub door 50 and may also be disposed in contact with the outer surface of the display assembly 60.

Specifically, the touch cable 601 may be extended upward from an upper end of the touch sensor 612 to be connected with the touch PCB 603. The touch cable 601 may be formed in a flat shape and may be bent to have an extended end connected with the touch PCB 603.

The display cables 605 may be connected with the source board 621 coupled to the inner surface of the outer spacer 67 and may be bent and extended upward, and may be extended along the border of the side surface of the display assembly 60 and then may be connected with the T-CON board 602.

Cable connectors 605*a* may be provided on the display cables 605. The cable connectors 605*a* may be drawn inward the display assembly 60 through a space formed between the rear panel 65 and an end of the outer spacer 67, and may be connected with the source board 621 in the inner space of the display 62.

An adhesive member 678 such as a double-sided tape or an adhesive may be provided on an end of the outer spacer 67 to be attached to the rear panel 65, and the cable connector 605*a* may be guided to the outside of the outer spacer 67 through the adhesive member 678.

The backlight cables 606 may be connected to the backlights 68 provided on the upper portion and the lower portion of the display assembly 60, respectively, and may be extended upwardly along the outer border of the display assembly 60 and then may be connected with the docking PCB 604.

The backlight cables 606 may extend inward from the display assembly 60 through a space between the rear panel 65 and the outer spacer 67, and may be connected with the backlights 68 disposed inside the outer spacer 67. The backlight cables 606 may be exposed to the outside through the adhesive members 678 for attaching the outer spacer 67 and the rear panel 65, and may be bent toward the docking PCB 604 and then may be extended along the border of the rear panel 65.

The plurality of flat cables 601, 605, 606 may be connected with the docking PCB 604, and the connection cable 607 connected with the docking PCB 604 may be guided to the outside of the sub door 50 and may be connected with the main controller 14. Accordingly, electronic components of the main controller 14 and the display assembly 60 may communicate with one another through the connection cable 607 and the cables 601, 605, 606, and may transmit information for operations to one another.

The display assembly 60 may have a second insulation layer 693 sealed between the light guide plate 64 and the insulation panel 72 by the second spacer 71, and may have a third insulation layer 694 sealed between the insulation panel 72 and the rear panel 65 by the third spacer 73. In addition, the display assembly 60 may have a first insulation layer 692 formed between the rear panel 65 and the front panel 61 by the outer spacer 67.

The second spacer 71 may be provided on the rear surface of the light guide plate 64. The second spacer 71 may have a tubular shape having both ends opened and having a hollow to have a polygonal cross section. The second spacer 71 may include tube members 711 defining upper, lower, left, and right sides, and corer connection members 712 formed at opened ends of the tube members 711 to define corners of the second spacer 66. The respective ends of the tube members 711 may be connected to intersect with one another by the corner connection members 712.

Figure 15:
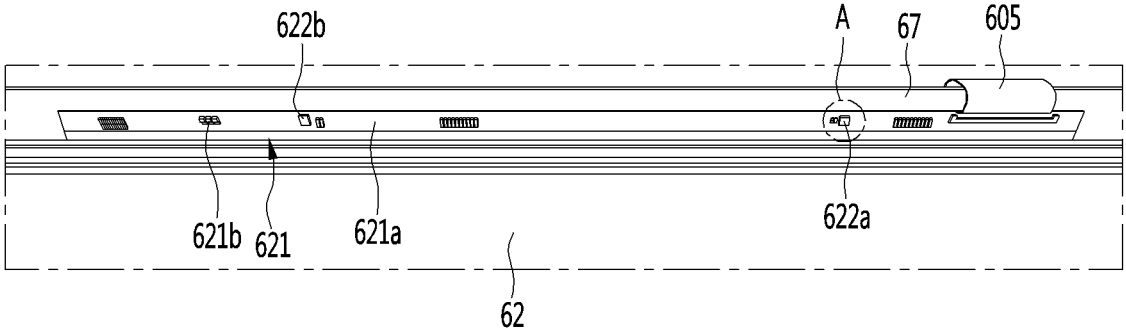
FIG. 15 is a view illustrating an outer spacer and a source board which are grounded through a conductive tape according to a first embodiment of the present disclosure.
Figure 16:
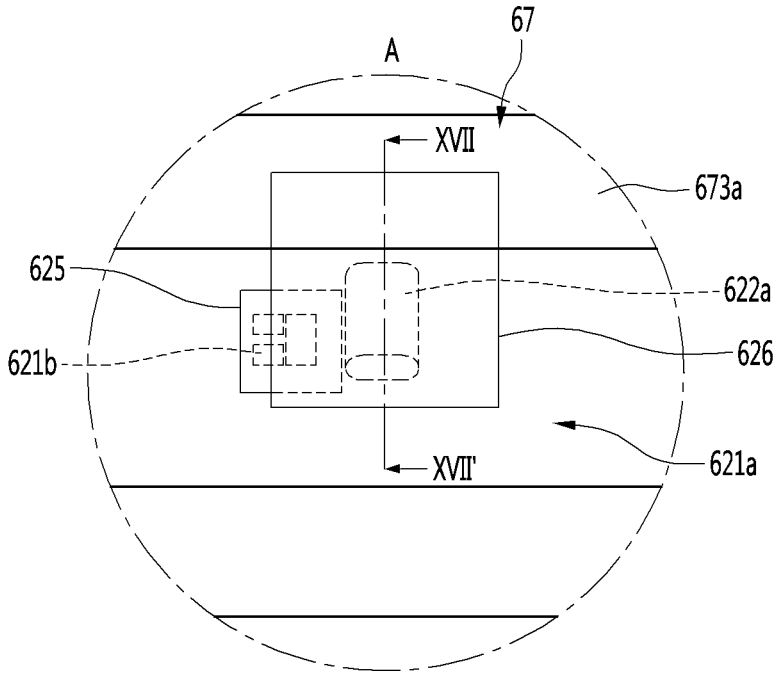
FIG. 16 is a view enlarging the portion "A" of FIG. 15.
Figure 17:
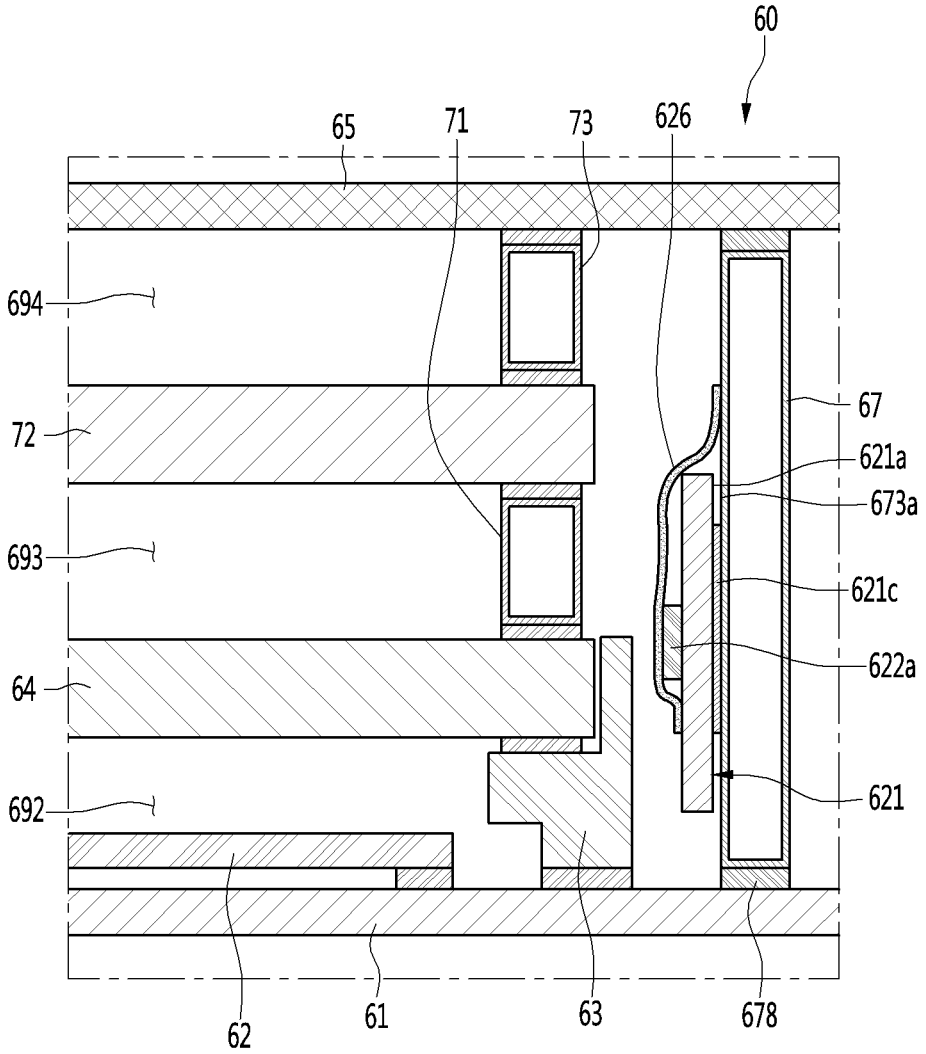
FIG. 17 is a cross-sectional view taken on line XVII-XVII' of FIG. 16.

Referring to FIGS. 15 to 17, the source board 621 may be disposed on the inner surface 673*a* of the outer spacer 67 according to the first embodiment, as a display PCB. The inner surface 673*a* may be an inner surface of the third portion 673 of the outer spacer 67 having the rectangular frame shape. The display cable 605 may be connected to the source board 621.

The source board 621 may include a board main body 621*a* of a thin plate structure which is extended longways in the vertical direction according to the extension direction of the third portion 673 of the outer spacer. For example, the board main body 621*a* may be attached to the inner surface 673*a* through an adhesive or a double-sided tape 621*c*. In addition, the source board 621 may further include a plurality of elements 621*b* installed in the board main body 621*a* to drive the display.

The source board 621 may further include ground terminals 622*a*, 622*b* provided on the board main body 621*a* to form a reference point of a voltage. The ground terminals 622*a*, 622*b* may include a first ground terminal 622*a* and a second ground terminal 622*b*. The first and second ground terminals 622*a*, 622*b* may be spaced apart from each other in the vertical direction.

When the backlights 68 are driven, a PWM signal generated at the backlights 68 may cause electromagnetic induction in the outer spacer 67, thereby changing a voltage waveform of the outer spacer 67. Accordingly, an electronic noise caused by electromagnetic waves may be introduced into the source board 621 disposed adjacent to the outer spacer 67, and may interfere with transmission of an image signal through the display cables 605. In this case, there may be a problem that white horizontal and vertical lines are displayed on the display 62.

Accordingly, the present disclosure aims at removing a bad influence on the source board 621 or the display cables 605 by discharging electromagnets waves transmitted through the outer spacer 67 to the outside, and enhancing image quality. To achieve this, the present embodiment is characterized in that the ground terminals 622*a*, 622*b* of the source board 621 are electrically connected with the outer spacer 67 to discharge electromagnetic waves toward the source board 621.

Specifically, the outer spacer 67 and the source board 621 may be connected with each other by a conductive tape 626. At least part of the conductive tape 626 may be attached to a surface of the outer spacer 67, that is, the inner surface 673*a*, and the other part may be attached to the ground terminals 622*a*, 622*b*. In this case, the conductive tape 626 may be configured to completely cover the ground terminals 622*a*, 622*b*.

The conductive tape 626 may be attached to any one or all of the first ground terminal 622*a* and the second ground terminal 622*b*. The element 621*b* may be disposed on the board main body 621*a* adjacent to the ground terminals 622*a*, 622*b*. In this case, an insulation tape 625 may be attached to the element 621*b* to prevent a short circuit from being caused due to the contact of the conductive tape 626 with the element 621*b*.

Specifically, the insulation tape 625 may be attached to the element 621*b*, first, and the conductive tape 626 may be attached to an outer surface of the insulation tape 625. Accordingly, electromagnetic waves may be prevented from acting on the element 621*b* through the conductive tape 626.

Figure 18A:
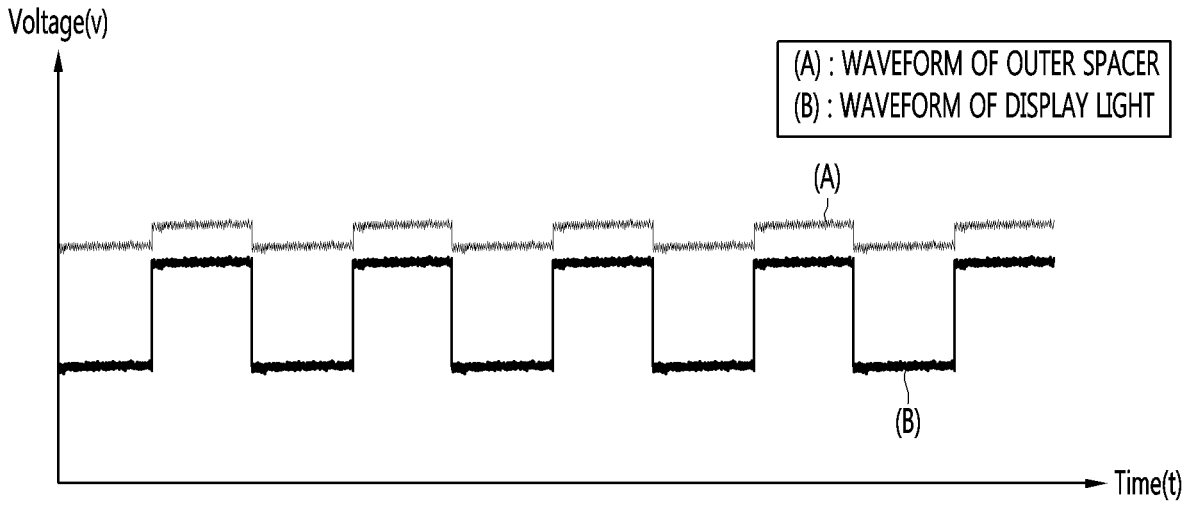
FIGS. 18A and 18B are graphs of experiments showing a change of a waveform of the outer spacer according to a waveform of the backlight according to related-art technology and the first embodiment of the present disclosure, respectively.

FIG. 18A illustrates a change A in a voltage waveform of the outer spacer 67 according to a change B in a PWM waveform generated in the backlight 68 (display light) when the outer spacer 67 and the source board 621 are not electrically connected with each other. In other words, a voltage floating phenomenon may appear due to electromagnetic waves generated in the proximity of the outer spacer 67. Such a phenomenon may result in degradation of quality of an image outputted through the display 62.

Figure 18B:
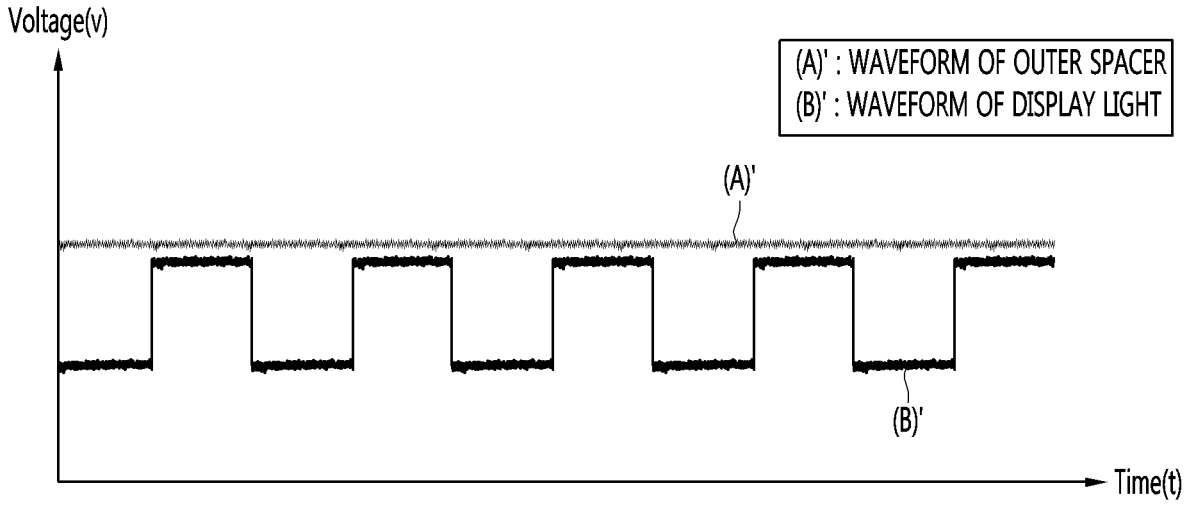

On the other hand, it can be seen from FIG. 18B that, when the outer spacer 67 and the source board 621 are electrically connected with each other as in the embodiment of the present disclosure, a voltage of the outer spacer 67 is constantly maintained (A') although a voltage waveform generated in the backlight 68 is changed (B'). Accordingly, quality of an image outputted through the display 62 may be enhanced.

Figure 19:
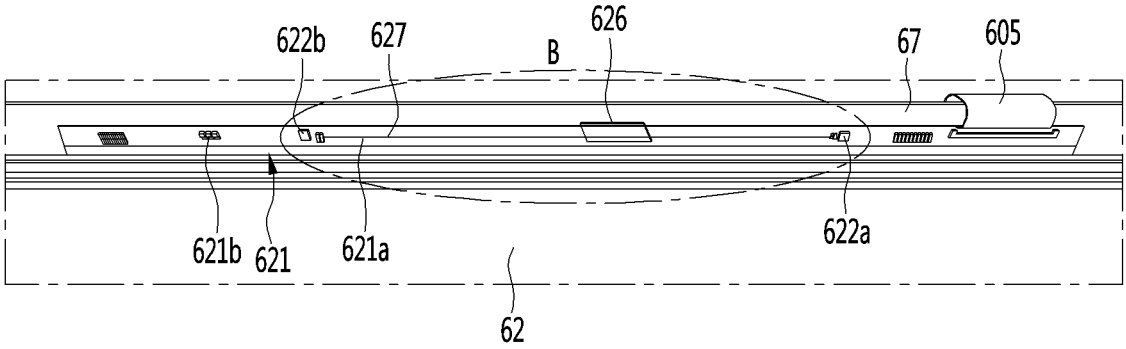
FIG. 19 is a view illustrating an outer spacer and a source board which are grounded through a conductive tape according to a second embodiment of the present disclosure.

Referring to FIG. 19, the outer spacer 67 and the source board 621 according to the second embodiment may be electrically connected with each other through the conductive tape 626. A ground pattern (or grounding line or grounding pattern or grounding wire) 627 may be provided in the source board 621 to connect first and second ground terminals 622*a*, 622*b*. The ground pattern 627 may be configured inside a board main body 621*a*. Specifically, the source board 621 may be configured by stacking a plurality of layers on which different types of elements 621*b* are arranged. The ground pattern 627 may be printed on any of the plurality of layers, and may be covered by the outer surface of the board main body 621*a*.

The ground pattern 627 may be configured to be extended from the first ground terminal 622*a* to the second ground terminal 622*b*.

The board main body 621*a* may have a cutaway portion 621*d* formed thereon to expose the ground pattern 627. The cutaway portion 621*d* may be formed by cutting out at least part of the outer surface of the board main body 621*a*, and at least part of the ground pattern 627 may be exposed to the outside through the cutaway portion 621*d*.

The conductive tape 626 may be attached to the ground pattern 627 exposed to the outside through the cutaway portion 621*d*. That is, the conductive tape 626 may be attached to the outer spacer 67 and the ground pattern 627, thereby electrically connecting the outer spacer 67 and the ground pattern 627.

Figure 20:
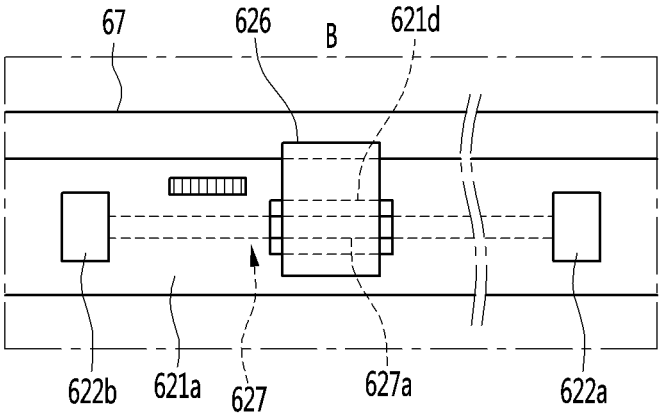
FIG. 20 is a view enlarging the portion "B" of FIG. 19.
Figure 21:
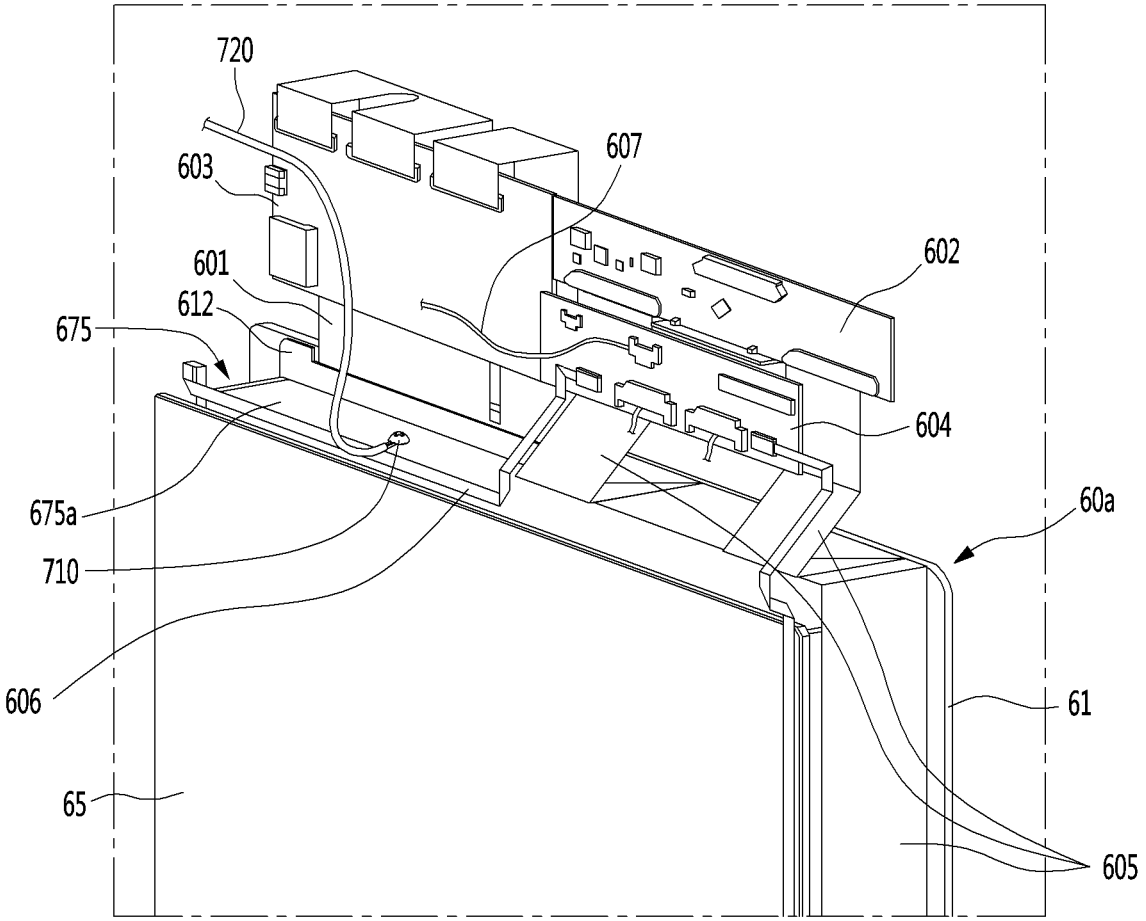
FIG. 21 is a perspective view of a display assembly showing a ground cable which is connected to an outer spacer according to a third embodiment of the present disclosure.
Figure 22:
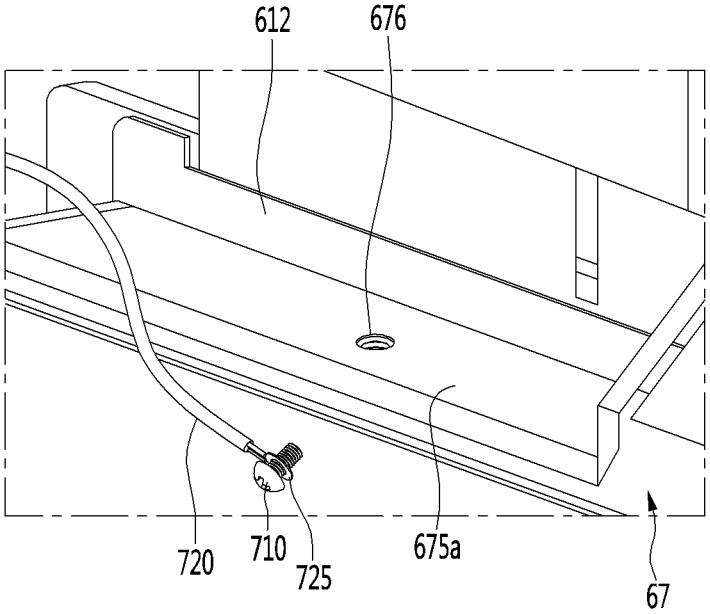
FIG. 22 is a view illustrating configurations of the outer spacer and the ground cable according to the third embodiment of the present disclosure.

FIG. 20 is a perspective view of a display assembly in which a ground cable is connected to an outer spacer according to a third embodiment, FIG. 21 is a view illustrating configurations of the outer spacer and the ground cable according to the third embodiment, and FIG. 22 is a view illustrating the outer spacer and the ground cable which are fastened to each other according to the third embodiment.

Referring to FIGS. 20 to 22, the display assembly 60*a* according to an embodiment may include the ground cable 720 grounded to the Earth and the outer spacer 67 electrically connected to the ground cable 720.

Specifically, as described in the first embodiment, the outer spacer 67 includes a second portion 675, and the ground cable 720 is coupled to an upper surface 675*a* of the second portion 675 of the outer spacer 67. For example, the ground cable 720 may be fastened to the second portion 675 of the outer spacer 67 by means of a screw 710.

Specifically, a fastening hole 676 may be formed on the second portion 675 of the outer spacer 67 to have the screw 710 fastened thereinto. In addition, a screw inserter 725 may be provided on an end of the ground cable 720 to have the screw 710 coupled thereto. The screw inserter 725 may have an annular shape to allow the screw 710 to be inserted thereinto, and may be formed with a conductor electrically connected with the ground cable 720.

The screw 710 may penetrate through the ground cable 720 through the screw inserter 725, and may be fastened into the fastening hole 676 of the second portion 675 of the outer spacer 67. For example, screw threads may be formed on the outer circumference of the screw 71 and may be fastened into the fastening hole 676 by rotation.

According to the present embodiment, since electromagnetic waves transmitted to the outer spacer 67 may be discharged to the outside through the ground cable 720, a noise can be prevented from entering the source board 621.

Figure 23:
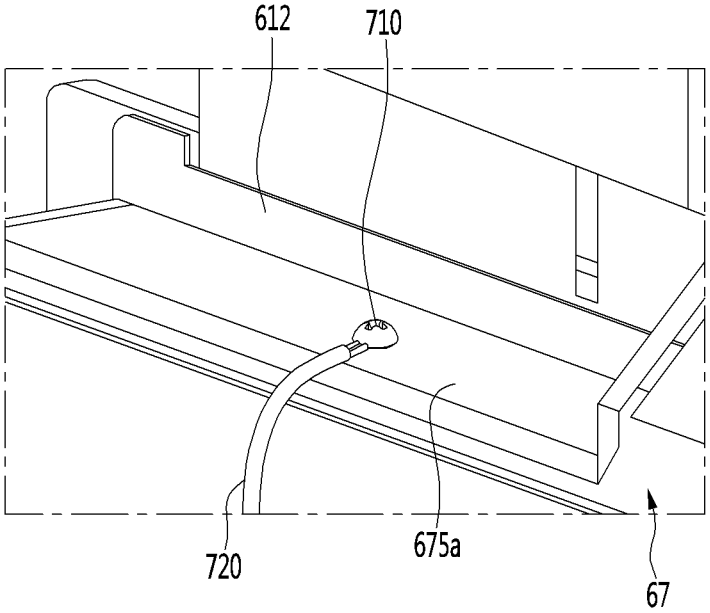
FIG. 23 is a view illustrating the outer spacer and the ground cable which are fastened to each other according to the third embodiment of the present disclosure.
Figure 24:
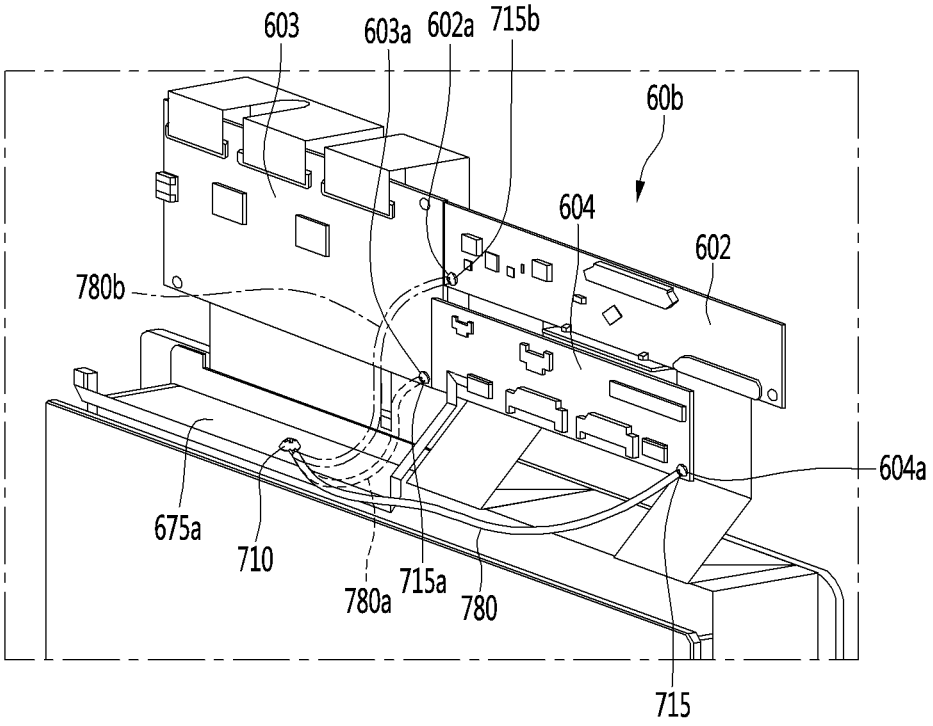
FIG. 24 is a view illustrating a PCB and a ground cable which are grounded according to a fourth embodiment of the present disclosure.

FIG. 23 is a view illustrating a PCB and a ground cable which are grounded according to a fourth embodiment.

Referring to FIG. 23, a display assembly 60*b* according to the fourth embodiment includes a PCB disposed outside a display 62, and an outer spacer connection cable 780 grounded to the PCB.

Specifically, a docking PCB 604 for the PCB may be included. The docking PCB 604 may include a ground terminal 604*a* and the outer spacer connection cable 780 may be connected to the ground terminal 604*a*. For example, the outer spacer connection cable 780 may be fastened to the ground terminal 604*a* by means of a screw 715.

In addition, the outer spacer connection cable 780 may be fastened to an upper surface 675*a* of a second portion 675 of the outer spacer 67 by means of a screw 710. For convenience of explanation, the screw 710 may be referred to as a "first screw," and the screw 715 may be referred to as a "second screw."

Another example is suggested.

In the above explanation, it is illustrated that the outer spacer connection cable 780 is connected to the upper surface 675*a* of the outer spacer 67 and the ground terminal 604*a* of the docking PCB 604, but the outer spacer connection cable may be configured to be grounded to another PCB.

For example, a touch PCB 603 may be disposed on an outside of the display 62, and an outer spacer connection cable 780*a* may be connected to the touch PCB 603 (cable illustrated by a dashed line). In addition, the touch PCB 603 may include a ground terminal 603*a*, and the outer spacer connection cable 780*a* may be fastened to the ground terminal 603*a* by means of a screw 715*a*.

Still another example is suggested.

A T-CON board 602 may be disposed on an outside of the display 62, and an outer spacer connection cable 780*b* may be connected to the T-CON board 602 (cable illustrated by a dash-dot line). In addition, the T-CON board 602 may include a ground terminal 602*a*, and the outer spacer connection cable 780*b* may be fastened to the ground terminal 602*a* by means of a screw 715*b*.

For convenience of explanation, the ground terminals 604*a*, 603*a*, 602*a* may be referred to as first to third ground terminals 604*a*, 603*a*, 602*a*, respectively.

It is illustrated in the above explanation that the outer spacer connection cable is grounded to any one PCB of the plurality of PCBs, but the outer spacer connection cable may be configured to be grounded to two or more PCBs.

As described above, since electromagnetic waves transmitted to the outer spacer 67 may be discharged to any one of the plurality of PCBs 602, 603, 604 through the outer spacer connection cable 780, 780*a*, 780*b*, a noise can be prevented from entering the source board 621.

The conductive tape 626, the ground cable 720, and the outer spacer connection cable 780 described above function as guide devices to discharge electromagnetic waves transmitted to each of the outer spacers 67 to the ground forming a reference point of a voltage, and therefore, may be referred to as "ground discharge mechanisms" or "electrical connectors."

Figure 25:
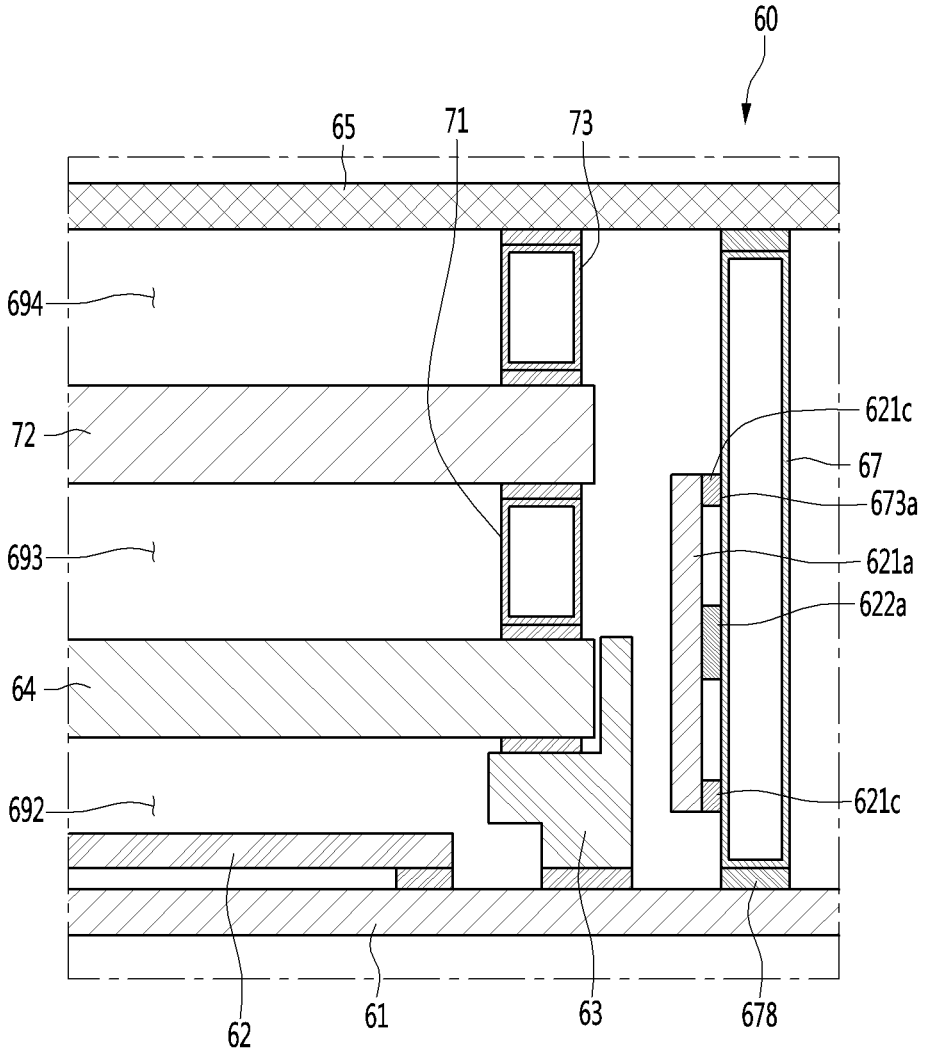
FIG. 25 is a view illustrating an outer spacer and a source board which are grounded through a conductive tape according to a fifth embodiment of the present disclosure.

FIG. 25 is a view illustrating an outer spacer and a source board which are grounded through a conductive tape according to a fifth embodiment.

Referring to FIG. 25, a ground terminal 622*a* of the source board according to the fifth embodiment may be configured to be in contact with the outer spacer 67. That is, the ground terminal 622*a* may be configured to protrude from one surface facing the outer spacer 67, and may be in contact with the outer spacer 67.

In this case, there is an advantage that the configuration of the conductive tape described in the first embodiment is not required.

Embodiments of the present disclosure provide a refrigerator in which at least part of a door is configured to be transparent, such that the inside of the refrigerator is visible even when the door of the refrigerator is closed, and which is able to output a screen through a display provided on the door.

Embodiments of the present disclosure also provide the refrigerator in which an outer spacer supporting the display, and a ground are grounded, thereby discharging electromagnetic waves transmitted from the outer spacer to the outside, and thus preventing the electromagnetic waves from acting as a noise to an image signal of the display.

In particular, embodiments of the present disclosure also provide the refrigerator in which the ground is configured as a ground terminal of a circuit board adjacent to the outer spacer, thereby easily discharging electromagnetic waves.

In another example, embodiments of the present disclosure also provide the refrigerator in which the ground is configured as a ground cable connected to the Earth, thereby easily discharging electromagnetic waves.

In addition, embodiments of the present disclosure also provide the refrigerator in which the outer spacer and the ground are easily grounded by utilizing a conductive tape or a screw.

In addition, embodiments of the present disclosure also provide the refrigerator in which the outer spacer is formed with a non-metallic material, such that the outer spacer is less influenced by ambient electromagnetic waves.

In a refrigerator according to an embodiment of the present disclosure, a conductor positioned in the proximity of a display, for example, a structure formed with a metallic material or a structure having a metal plating layer, is grounded with a ground, such that a noise generated in the structure can be prevented from acting on the display.

The ground may include a ground or an Earth ground provided in a circuit board.

In particular, the structure may include an outer spacer supporting the display, and the outer spacer is grounded with the ground, such that electromagnetic waves transmitted to the outer spacer can be discharged to the outside. Therefore, the electromagnetic waves can be prevented from acting on a display image as a noise.

In addition, the ground may include a ground terminal of a circuit board for driving the display, and the outer spacer and the ground terminal may be grounded through a conductive tape. Therefore, a grounding method can be easily performed.

In addition, the ground may include a ground cable grounded to the Earth, and the ground cable may be electrically connected with the outer spacer. Therefore, a grounding method can be easily performed.

In addition, the circuit board may include a source board provided on a side surface of the display, and the source board may be attached to an inner surface of the outer spacer which is formed in a rectangular frame shape, and the ground of the source board and the outer spacer are easily grounded.

In addition, the circuit board may include one or more circuit boards provided on an outside of the display, for example, an upper side, and the outer spacer and the circuit board are electrically connected with each other through a ground cable. Therefore, grounding can be easily achieved.

In addition, the ground cable may be fastened to the outer spacer or the circuit board by using a screw. Therefore, a grounding method can be easily performed.

A display assembly includes a front panel and a rear panel, and an outer spacer which is coupled to the front panel and the rear panel and spaces the front panel and the rear panel apart from each other, and the front and rear panels and the outer space define an insulation space formed therein.

The outer spacer may have a spacer opening penetrating therethrough, and may have a substantially rectangular frame shape.

A display be disposed in a space formed between the front panel and the rear panel to output an image.

A source board may be attached to the outer spacer to control the operation of the display.

In addition, the display assembly may further include a ground discharge mechanism to electrically connect the outer spacer and a ground.

The ground discharge mechanism may include a conductive tape.

The ground may include a ground terminal provided in the source board.

The outer spacer may include: a first portion disposed on a lower portion of the display assembly; a second portion disposed on an upper portion of the display assembly; and third portions extended from both sides of the first portion toward the second portion.

The source board may be disposed on inner surfaces of the third portions, and the conductive tape may be attached to the ground terminal of the source board and the outer spacer.

The source board may include: a board main body attached to the third portions; and an element installed in the board main body to operate the display.

The refrigerator may further include an insulation tape attached to the element, and the conductive tape may be attached to a surface of the insulation tape.

The ground may include a ground pattern printed on the source board.

The ground discharge mechanism may include a ground cable grounded to the Earth.

A screw screwed into the outer spacer may further be included, and the screw may fix the ground cable to the outer spacer.

A screw inserter to be coupled to the ground cable may further be included, and the screw may be fastened to the outer spacer by passing through the screw inserter.

The refrigerator may further include: a T-CON board configured to adjust a timing of an image signal inputted to the display; a touch PCB electrically connected with a touch sensor disposed on the display; and a docking PCB connected with a main controller disposed on the cabinet.

The ground discharge mechanism may include any one of a ground terminal of the T-CON board, a ground terminal of the touch PCB, and a ground terminal of the docking PCB.

The refrigerator may further include a screw fastened to the outer spacer, and an outer spacer connection cable connected to the screw and grounded to the ground discharge mechanism.

The door may include a main door defining a through hole; and a sub door pivotably disposed on a front side of the main door, and the display assembly may be installed on the sub door.

According to embodiment of the present disclosure, at least part of the door of the refrigerator is configured to be transparent, such that the inside of the refrigerator is visible even when the door of the refrigerator is closed, and a screen can be outputted through the display provided on the door. Therefore, user convenience of the refrigerator can be enhanced.

In addition, the outer spacer supporting the display, and the ground are grounded, thereby discharging electromagnetic waves transmitted from the outer spacer to the outside, and thus preventing the electromagnetic waves from acting as a noise to an image signal of the display.

In particular, the ground is configured as a ground terminal of a circuit board adjacent to the outer spacer, thereby easily discharging electromagnetic waves.

In another example, the ground is configured as a ground cable connected to the Earth, thereby easily discharging electromagnetic waves.

In addition, the outer spacer and the ground are easily grounded by utilizing a conductive tape or a screw.

In addition, the outer spacer is formed with a non-metallic material, such that the outer spacer is less influenced by ambient electromagnetic waves.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:
- a cabinet;
- a door configured to open and close the cabinet, the door having an opening formed therethrough;
- a light provided on the cabinet or the door; and
- a display assembly that covers the opening of the door, wherein the display assembly comprises:
  - a front panel and a rear panel;
  - an outer spacer provided between the front panel and the rear panel and configured to define an insulation space between the front panel, the rear panel, and the outer spacer;
  - a display provided within the insulation space; and
  - a connector provided at the outer spacer, the connector being configured to discharge electromagnetic waves being transferred to the outer spacers to outside of the display assembly.

2. The refrigerator of claim 1, further comprising:
- a source board attached to the outer spacer, the source board including a ground terminal,
- wherein the connector is electrically coupled to the ground terminal of the source board.

3. The refrigerator of claim 2, wherein the connector comprises a conductive tape.

4. The refrigerator of claim 3, wherein the conductive tape is attached to the outer spacer and the ground terminal.

5. The refrigerator of claim 4, wherein the outer spacer comprises:
- a bottom spacer provided below the display assembly;
- a top member provided above the display assembly; and
- a side spacer provided at each lateral side of the display assembly and configured to connect the top spacer to the bottom spacer.

6. The refrigerator of claim 5, wherein the source board is attached to an inner surface of at least one of the side spacers, and wherein the conductive tape is attached to the ground terminal of the source board and the inner surface.

7. The refrigerator of claim 6, wherein the source board comprises:
- a board main body attached to an inner surface of at least one of the side members; and
- a circuitry provided on the board main body.

8. The refrigerator of claim 7, further comprising an insulation tape attached to the circuitry, wherein the conductive tape is attached to the insulation tape.

9. The refrigerator of claim 3, wherein the source board further comprises at least one grounding line connected to the ground terminal, the grounding line being printed on the source board, and wherein the conductive tape is attached to the grounding line.

10. The refrigerator of claim 1, wherein the connector comprises a ground cable connected to a ground, wherein the ground cable is electrically coupled to the outer spacer.

11. The refrigerator of claim 10, further comprising a screw screwed into the connector, and wherein the screw is configured to fix the ground cable to the outer spacer.

12. The refrigerator of claim 11, further comprising a screw inserter that protrudes from the ground cable, wherein the screw penetrates through the screw inserter and is screwed into the outer spacer.

13. The refrigerator of claim 1, further comprising:

at least one printed circuit board (PCB) provided outside the outer spacer, wherein the connector comprises a connection cable electrically connected with the at least one PCB and the outer spacer.

14. The refrigerator of claim 13, wherein the at least one PCB comprises a plurality of PCBs, which comprises:

a timing controller (T-CON) board configured to adjust a timing of an image signal input to the display;

a touch PCB electrically connected with a touch sensor attached to the display; and a docking PCB connected with a main controller provided on the cabinet, wherein the connection cable is connected to a ground terminal of the T-CON board, a ground terminal of the touch PCB, or a ground terminal of the docking PCB.

15. The refrigerator of claim 13, wherein the connection cable includes a screw fastened to the outer spacer.

16. The refrigerator of claim 2, wherein the connector is connected to one point of the outer spacer, and wherein the connector is in contact with the ground terminal of the source board.

17. The refrigerator of claim 1, wherein the door comprises:

a main door that defines an opening; and a sub door pivotably attached to a front of the main door and configured to open or close the opening of the main door, wherein the display assembly is installed on the sub door.

18. The refrigerator of claim 1, further comprising a light provided on the cabinet or the door, wherein the display assembly is configured to implement any one mode of:

a transparent mode in which the light is turned on, and an inside of the storage space is visible through the display assembly;

an opaque mode in which the light is turned off and the inside of the storage space is hidden; and a display mode in which the light is turned off and the display operates.

19. The refrigerator of claim 18, wherein the display assembly further comprises a backlight provided at a rear of the display, wherein, when the display assembly is in the transparent mode or the opaque mode, the backlight is turned off, and when the display assembly is in the display mode, the backlight is turned on.

* * * * *